US010161412B2

(12) United States Patent
Kim et al.

(10) Patent No.: US 10,161,412 B2
(45) Date of Patent: Dec. 25, 2018

(54) CENTRIFUGAL FAN ASSEMBLY

(71) Applicant: Samsung Electronics Co., Ltd., Suwon-si (KR)

(72) Inventors: Hooi Joong Kim, Yongin-si (KR); Ho Choi, Hwaseong-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 278 days.

(21) Appl. No.: 14/975,234

(22) Filed: Dec. 18, 2015

(65) Prior Publication Data

US 2016/0177966 A1 Jun. 23, 2016

(30) Foreign Application Priority Data

Dec. 18, 2014 (KR) ..... 10-2014-0183178

(51) Int. Cl.

| | |
|---|---|
| ***F04D 29/62*** | (2006.01) |
| ***F04D 29/28*** | (2006.01) |
| ***F04D 29/02*** | (2006.01) |
| ***F04D 29/30*** | (2006.01) |
| ***F04D 17/16*** | (2006.01) |

(52) U.S. Cl.

CPC ..... *F04D 29/281* (2013.01); *F04D 17/16* (2013.01); *F04D 29/023* (2013.01); *F04D 29/30* (2013.01); *F04D 29/624* (2013.01); *F05D 2230/21* (2013.01); *F05D 2230/232* (2013.01); *F05D 2250/20* (2013.01); *F05D 2300/43* (2013.01)

(58) Field of Classification Search

CPC ..... F04D 29/281; F04D 17/16; F04D 29/023; F04D 29/30; F04D 29/624; F05D 2230/21; F05D 2230/232; F05D 2250/20; F05D 2300/43

USPC ..... 416/179

See application file for complete search history.

(56) References Cited

U.S. PATENT DOCUMENTS 70,286 A * 10/1867 Sturtevant ..... F04D 29/283 416/178
1,926,225 A * 9/1933 Birmann ..... F04D 29/285 415/224.5

(Continued)

FOREIGN PATENT DOCUMENTS

| | | |
|---|---|---|
| CN | 1395046 | 2/2003 |
| CN | 1961155 | 5/2007 |

(Continued)

OTHER PUBLICATIONS

European Search Report for Appln No. 15201226 dated May 18, 2016.

(Continued)

*Primary Examiner* — Logan Kraft
*Assistant Examiner* — Brian Delrue
(74) *Attorney, Agent, or Firm* — Staas & Halsey LLP

(57) ABSTRACT

Disclosed herein is a plurality of blades with a three-dimensional shape injection-molded at the same time, thereby reducing processes of manufacturing a centrifugal fan assembly. A centrifugal fan assembly includes a blade assembly formed by integrally injection-molding a plurality of blades where at least a part thereof is bent and a fixing portion, and a hub plate to which the fixing portion of the blade assembly is coupled, where the fixing portion includes at least one opening to allow extraction of the blade assembly from the mold.

21 Claims, 26 Drawing Sheets

(56) References Cited

U.S. PATENT DOCUMENTS

| | | | | | |
|---|---|---|---|---|---|
| 2,392,113 | A * | 1/1946 | Anderson | F04D 29/283 | 29/889.4 |
| 2,458,041 | A * | 1/1949 | Wessel | F04D 29/283 | 200/33 R |
| 2,962,207 | A * | 11/1960 | Mayne | F04D 29/283 | 29/889.4 |
| 5,165,855 | A * | 11/1992 | Ricketts | F04D 29/283 | 416/178 |
| 6,368,062 | B1 * | 4/2002 | Yagami | F04D 29/282 | 416/178 |
| 7,070,389 | B2 * | 7/2006 | Kim | F04D 29/023 | 416/185 |
| 7,108,482 | B2 * | 9/2006 | Chapman | F04D 29/30 | 415/206 |
| 7,121,799 | B2 * | 10/2006 | Kim | F04D 29/023 | 416/186 R |
| 7,513,107 | B2 * | 4/2009 | Lehmann | F01N 3/32 | 60/280 |
| 7,669,637 | B2 * | 3/2010 | Kubota | B22C 9/04 | 164/137 |
| 7,762,778 | B2 * | 7/2010 | Purvines | B23P 15/006 | 416/186 A |
| 8,882,467 | B2 * | 11/2014 | Kwok | F04D 29/023 | 416/186 R |
| 9,109,605 | B2 * | 8/2015 | Chou | F04D 29/023 | |
| 9,261,107 | B2 * | 2/2016 | Kim | F04D 29/30 | |
| 9,502,944 | B2 * | 11/2016 | Neet | H02K 9/06 | |
| 9,810,234 | B2 * | 11/2017 | Bahren | F04D 29/283 | |
| 9,890,797 | B2 * | 2/2018 | Wilfley | F04D 29/622 | |
| 2002/0028138 | A1 * | 3/2002 | Lee | F04D 29/023 | 415/206 |
| 2003/0077174 | A1 * | 4/2003 | Kim | F04D 29/283 | 416/186 R |
| 2004/0253126 | A1 * | 12/2004 | Cheng | F04D 29/023 | 417/423.1 |
| 2005/0071998 | A1 * | 4/2005 | Rocky | B29C 65/08 | 29/889 |
| 2005/0260070 | A1 * | 11/2005 | Hsu | F04D 25/0606 | 415/199.6 |
| 2008/0063542 | A1 * | 3/2008 | Oguma | F04D 25/0613 | 417/354 |
| 2008/0156461 | A1 * | 7/2008 | Otsuki | F04D 29/582 | 165/80.3 |
| 2010/0215486 | A1 * | 8/2010 | Shirahama | F04D 29/283 | 415/204 |
| 2011/0116928 | A1 | 5/2011 | Czulak et al. | | |
| 2011/0318189 | A1 * | 12/2011 | Teraoka | F04D 17/04 | 416/228 |
| 2012/0055656 | A1 | 3/2012 | Han et al. | | |
| 2012/0257965 | A1 * | 10/2012 | Xia | F04D 25/0613 | 415/213.1 |
| 2014/0133988 | A1 * | 5/2014 | Son | F04D 29/281 | 416/189 |
| 2015/0064009 | A1 * | 3/2015 | Huang | F04D 19/002 | 416/174 |
| 2015/0071782 | A1 * | 3/2015 | Bahren | F04D 29/283 | 416/189 |
| 2015/0275922 | A1 * | 10/2015 | Son | F04D 17/10 | 415/206 |
| 2016/0290355 | A1 * | 10/2016 | Lin | F04D 29/023 | |

FOREIGN PATENT DOCUMENTS

| | | | | |
|---|---|---|---|---|
| DE | 102007055614 | | 5/2009 | |
| EP | 1411247 | A1 | 4/2004 | |
| EP | 1709332 | A1 | 10/2006 | |
| KR | 20080056748 | | 6/2008 | |
| KR | 20110092962 | | 8/2011 | |
| KR | 20110124744 | | 11/2013 | |
| WO | 2005/073559 | A1 | 8/2005 | |
| WO | 2009/065894 | A1 | 5/2009 | |
| WO | WO 2009065894 | A1 * | 5/2009 | F04D 29/285 |

OTHER PUBLICATIONS

Chinese Office Action for Appln. No. 2015109058734.5 dated Aug. 18, 2017 (12 pages).

Chinese Office Action for Appln. No. 2015109058734.5 dated Mar. 22, 2018 (13 pages).

* cited by examiner

CENTRIFUGAL FAN ASSEMBLY

RELATED APPLICATION(S)

This application claims the benefit of Korean Patent Application No. 10-2014-0183178, filed on Dec. 18, 2014 in the Korean Intellectual Property Office, the disclosure of which is incorporated herein by reference.

BACKGROUND

Embodiments of the present disclosure relate to a centrifugal fan, and more particularly, to a centrifugal fan assembly with a fan that has a three-dimensional structure.

Air-conditioners or refrigerators include a blowing fan to discharge cooled air or high-temperature air generated by a compressor, etc. The blowing fan may include a fan motor and a centrifugal fan assembly driven by the fan motor.

The centrifugal fan assembly may generally include a hub connected to a fan motor with a plurality of blades around the hub, and a shroud. When the motor turns the fan, the blades blow air in a direction consistent with the design of the blades.

If an eddy forms on a top surface of the blade, noise may occur and there may be a loss of torque. As a method for overcoming this, centrifugal fans have been manufactured by injection-molding the plurality of blades in a three-dimensional shape, without the shroud.

Such blades may include a hub-side front end that faces one direction and an outermost-side rear end that faces the other direction. That is, a portion of one end of the blade may face one direction and a portion of the other end may face another direction.

From the hub-side front end to the outermost-side rear end may have a shape similar to S.

Conventionally, each blade with this type of three-dimensional shape is separately injection-molded and welded to a hub plate. Steel blades may be provided by bending or folding flat blades to a desired shape.

When the plurality of blades are separately installed on the hub plate, manufacturing costs may increase due to increased operation processes and imbalances among the blades may cause increasing noise when the centrifugal fan is operating.

SUMMARY

Therefore, it is an aspect of the present disclosure to provide a centrifugal fan assembly capable of more easily embodying a plurality of blades with three-dimensional shape.

Additional aspects of the disclosure will be set forth in the description that follows, which will be obvious from the description or may be learned by practice of the disclosure.

In accordance with one aspect of the present disclosure, a centrifugal fan assembly includes a blade assembly formed by integrally injection-molding a plurality of blades that have a shape in which at least a part thereof is bent and has a fixing portion, where the fixing portion is coupled to a hub plate, and where the fixing portion includes an opening formed to allow removal of the fan assembly from a mold.

Each blade of the plurality of blades may have a twisted shape with a first portion of a first end of each blade facing a first adjacent blade, and a second portion of a second end of each blade diagonal to the first portion of the first end facing a second adjacent blade The fixing portion may be connected to the first end of each of the blades and may be adjacent to a portion of one opening formed on a corresponding reference surface area overlapping with a plane of the fixing portion.

The opening may be formed to be at least as large as an area of the part in which the plane formed by the fixing portion and the respective blades located in front of the fixing portion overlap.

The opening may be at least in those parts where the plurality of blades and the fixing portion overlap when the blade assembly is viewed from a front.

The opening may be formed in an area in addition to a reference plane of the blade, which overlaps the fixing portion.

The reference plane may be one surface of the blade located on the same plane as the fixing portion.

The hub plate may include a concave portion to which the fixing portion is attached and a convex portion that corresponds to the opening.

When the fixing portion is attached to the concave portion, a forward surface of the convex portion and a forward surface of the fixing portion may form a plane.

The fixing portion may be welded to the concave portion after being fit into the concave portion.

The opening may be provided by opening the fixing portion adjacent to a surface of each of the blades.

The opening may be formed by further opening at least a part of the fixing portion adjacent to another surface of the blade.

The opening may include an open portion having a steep incline on one end of the blade.

A first hub may be provided on the hub plate.

A second hub may be provided on the blade assembly with a shape corresponding to the first hub on the hub plate.

A shaft connected to a fan motor may be mounted on the hub provided in the hub plate to receive torque.

In accordance with an aspect of the present disclosure, a centrifugal fan assembly includes a blade assembly that includes a plurality of blades integrally formed with curved surfaces, a hub plate with a hub in the center of the hub plate and on which the blade assembly is mounted, where the concave portion on which the blade assembly is mounted is formed in the hub plate.

The blade assembly may include a fixing portion.

An opening may be provided in at least one side of each of the plurality of blades allow removal of the blade assembly from a mold.

The opening may correspond to a part where a plane formed by the fixing portion and the respective blades located in front of the fixing portion overlap when the blade assembly is viewed from front.

The opening may be formed to be at least as large as an area of the part in which the plane formed by the fixing portion and the respective blades located in front of the fixing portion overlap.

When the blade assembly is mounted on the hub plate, the convex portion of the hub plate and the fixing portion may be a plane.

The fixing portion may be welded to the concave portion.

The fixing portion and the concave portion may be provided to fit together.

In accordance with an aspect of the present disclosure, a centrifugal fan assembly includes a blade assembly in which at least some of a plurality of blades are bent, a fixing portion that connects the blades and forms one plane are integrally formed and, a hub plate that includes a hub in a center of the hub plate and where the blade assembly is mounted, in which the blade assembly includes an opening that allows a mold to pass therethrough to injection-mold the blade assembly, and the hub plate includes a concave portion and a convex portion and when the fixing portion is mounted on the concave portion, the fixing portion and the convex portion form one connected plane.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Hereinafter, a centrifugal fan assembly 1 in accordance with an embodiment of the present disclosure will be described in detail with reference to the attached drawings.

Figure 1:
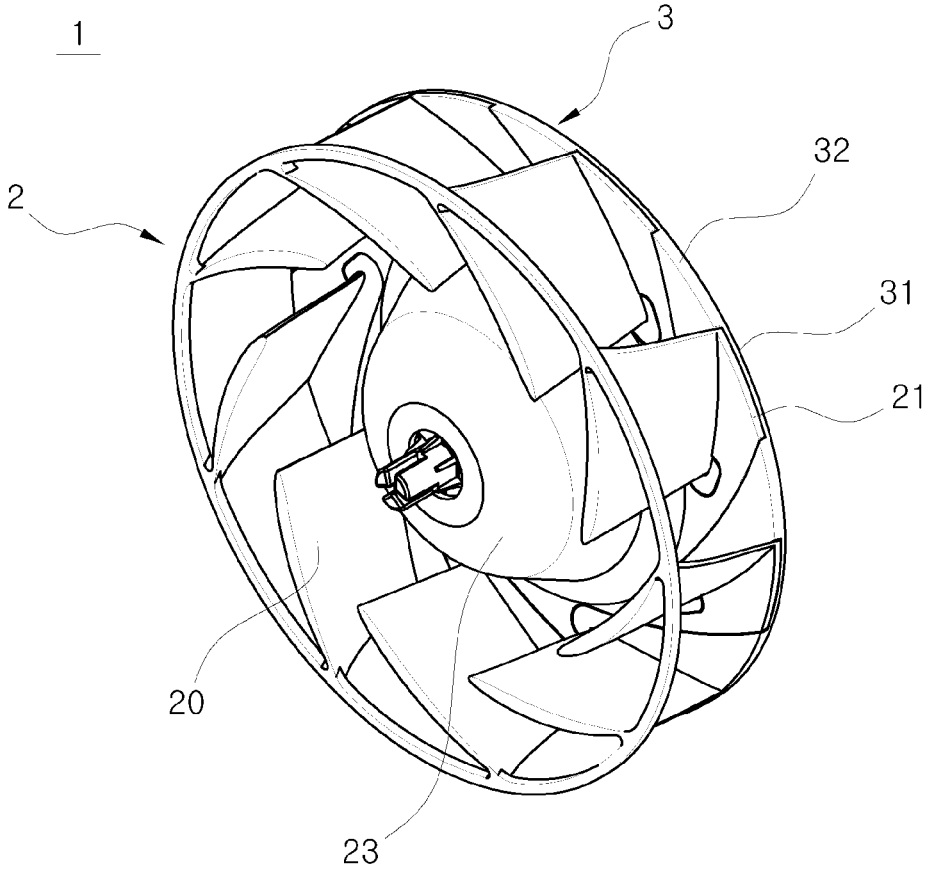
FIG. 1 is a perspective view of a centrifugal fan assembly in accordance with an embodiment of the present disclosure.
Figure 2:
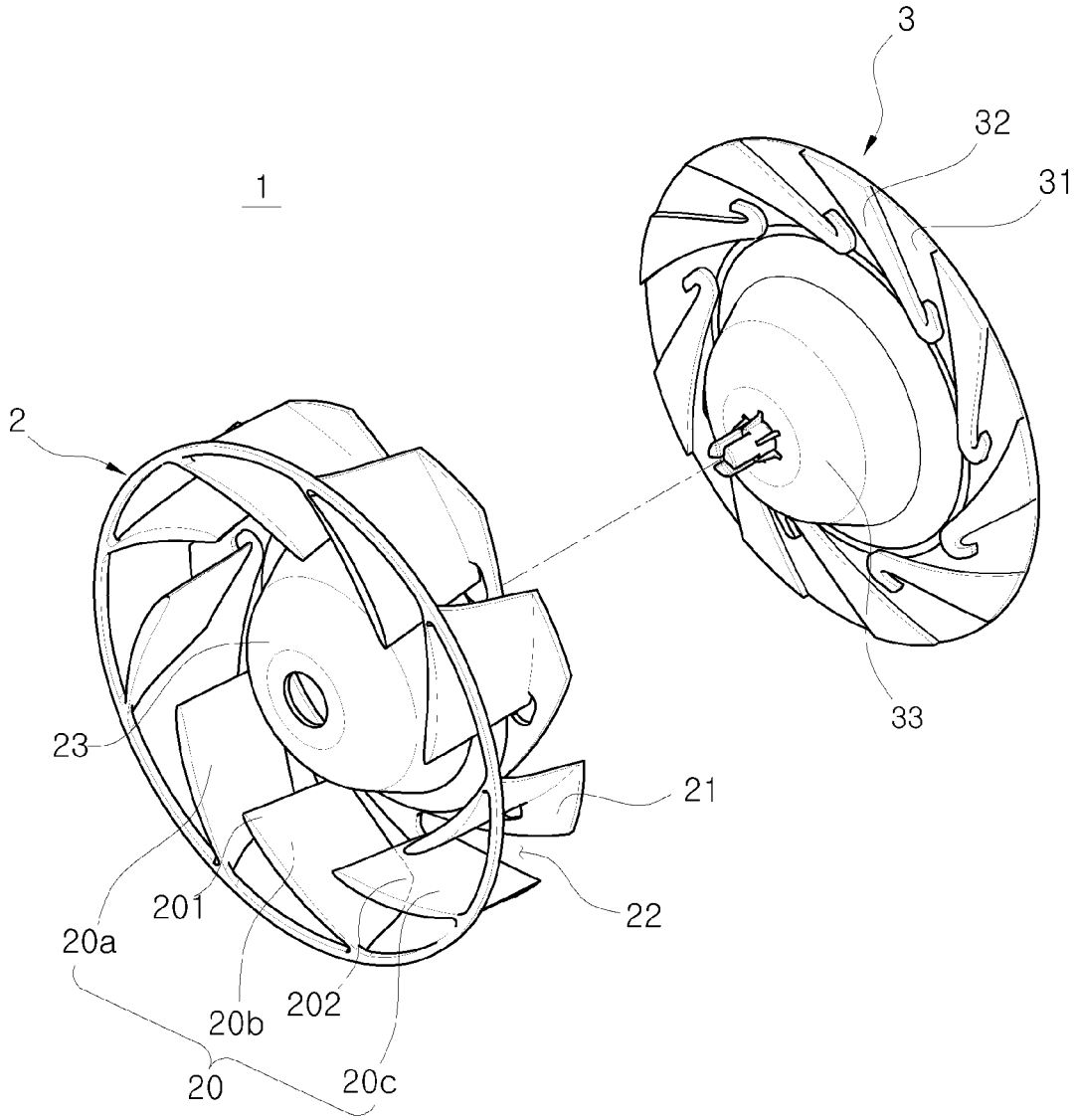
FIG. 2 is an exploded perspective view of the centrifugal fan assembly in accordance with an embodiment of the present disclosure.
Figure 6:
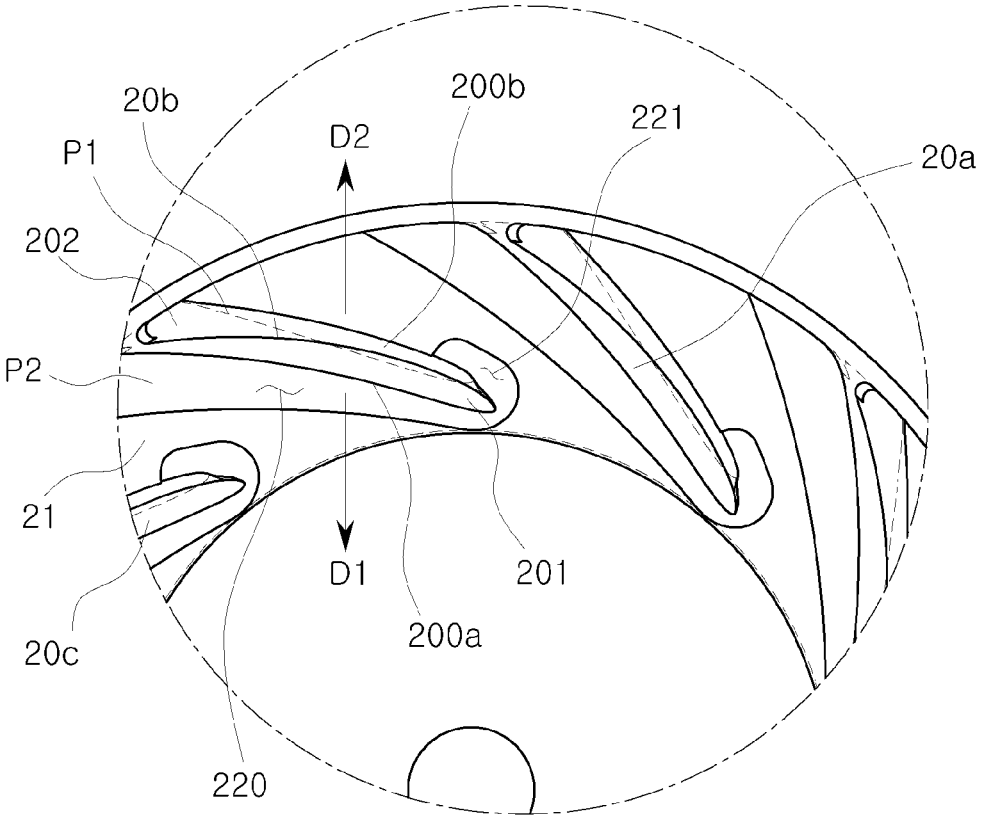
FIG. 6 is a partial view of the blade assembly in accordance with an embodiment of the present disclosure.

FIG. 1 is a perspective view of the centrifugal fan assembly in accordance with an embodiment of the present disclosure. FIG. 2 is an exploded perspective view of the centrifugal fan assembly in accordance with an embodiment of the present disclosure. FIG. 6 is a partial view of the blade assembly in accordance with an embodiment of the present disclosure.

Referring to FIGS. 1, 2, and 6, a centrifugal fan assembly 1 may include a blade assembly 2 and a hub plate 3. The blade assembly 2 may be installed in front of the hub plate 3. A fan motor (motor 80 in FIG. 8) may be installed in the rear of the hub plate 3 to transfer torque to the centrifugal fan assembly 1 (via shaft 80*a* in FIG. 8).

The blade assembly 2 includes a hub 23 at the center of the blade assembly 2, and blades 20 may be located around the hub 23 at a regular interval. At least some of the blades 20 may have a curved shape.

The blade assembly 2 includes a fixing portion 21 that is used to connect the blade assembly 2 to the hub plate 3. An opening 22 may be formed in the fixing portion 21. The opening 22 will be described below in detail. The blades 20, the fixing portion 21, and the hub 23 may be integrally injection-molded.

Each of the blades 20 in the blade assembly 2 may have a three-dimensional shape to allow better flow to reduce the occurrence of eddies near the blades 20.

Accordingly, each of the blades 20 may have a curved three-dimensional shape where one end may face frontward and the other end may face rearward. That is, the blades 20 may substantially have an S-shape.

FIG. 2 shows a first blade 20*a*, a second blade 20*b*, and a third blade 20*c*. The first blade 20*a*, the second blade 20*b*, and the third blade 20*c* may be located at a regular interval next to each other in a counterclockwise direction. A hub end 201 of the second blade 20*b* may be curved forward toward the third blade 20*c* and an outer end 202 of the second blade 20*b* may be curved toward the first blade 20*a*.

A direction in front of a surface 200*a* (FIG. 6) of the second blade 20*b* that faces one side of the third blade 20*c* is referred to as a first direction D1 and the opposite direction is referred to as a second direction D2. The hub end 201 located near the hub 23 may be bent in the first direction D1 and the outer end 202 located near an outer circumference of the blade assembly 2 may be curved in the second direction D2.

Part of the hub end 201 of the second blade 20*b* may be curved in the first direction D1 in which the third blade 20*c* is located, and part of the outer end 202 of the second blade 20*b* in contact with the fixing portion 21 may be bent in the second direction D2 in which the first blade 20*a* is located, thereby providing the second blade 20*b* with a three-dimensional twisted shape. The hub end 201 and the outer end 202 of the second blade 20*b* may be located on a diagonal line of the second blade 20*b*.

Shapes of the other blades 20 including the first blade 20*a* and the third blade 20*c* may have a three-dimensional shape similar to the shape of the second blade 20*b*. Hereinafter, the fixing portion 21 and the opening 22 will be described based on the second blade 20*b*. The content related to the fixing portion 21 and the opening 22 may be similarly applied to the other blades 20 including the first blade 20*a* and the third blade 20*c*.

The blade assembly 2 may include the fixing portion 21 installed on the hub plate 3. The blades 20 may be at right angles with the fixing portion 21. For example, the opening 22 may be formed in the fixing portion 21 located near the second blade 20*b*. A relationship between the three-dimensional shape of the blades 20 and the opening 22 will be described in detail with respect to FIGS. 4-6.

The blade assembly 2 may be installed on the hub plate 3. A hub 33 may be at a center of the hub plate 3. The hub 33 may correspond to the hub 23 in the blade assembly 2.

A concave portion 31 and a convex portion 32 may be provided on the hub plate 3. The concave portion 31 may be provided to correspond to a shape of the fixing portion 21 included in the blade assembly 2. The fixing portion 21 of the blade assembly 2 may be inserted into the concave portion 31. When the fixing portion 21 is inserted into the concave portion 31, the fixing portion 21 and the convex portion 32 may form the same plane. The fixing portion 21 may be fixedly inserted into the concave portion 31. For example, the fixing portion 21 may be inserted into and welded to the concave portion 31. When the blade assembly 2 and the hub plate 3 are coupled with each other, the concave portion 31 may not be exposed in a forward direction and the fixing portion 21 and the convex portion 32 may form one connected plane.

FIGS. 3A to 3D are schematic diagrams illustrating injection-molded materials and molds.

Referring to FIGS. 3A to 3D, a mold includes a first mold A and a second mold B. A cavity corresponding to a desired shape in the first mold A and the second mold B may be filled with injection-molded material C. When raw injection-molded material C is injected into the cavity and cooled after heat is applied, the injection-molded material C may be cured to a desired shape. When the injection-molded material C is cured corresponding to the shape of the cavity, the first mold A and the second mold B may be separated from each other and the injection-molded material C located in the mold may be extracted.

Hereinafter, it will be assumed that after the injection-molded material C is cured, the first mold A moves upward and is separated from the second mold B, and the injection-molded material C located in the second mold B is extracted by an extraction member.

Figure 3A:
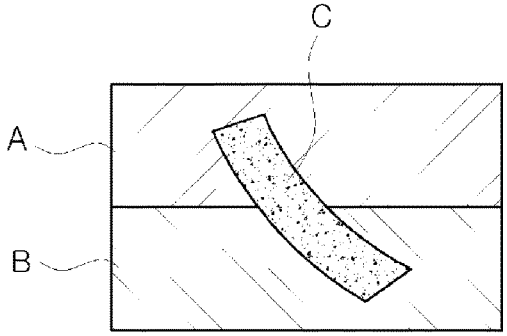
FIGS. 3A to 3D are diagrams illustrating injection-molded materials and molds.
Figure 3B:
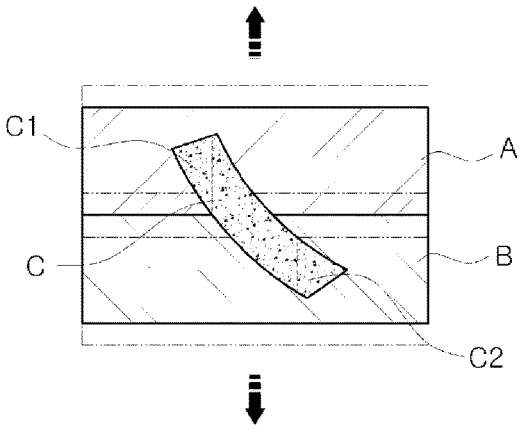

When a shape of the injection-molded material C is extends from an upper-left portion of a mold to a lower-right portion as shown in FIG. 3B, the movement of the first mold A and the extraction of the injection-molded material C from the second mold B may be blocked by the upper-left portion C1 and the lower-right portion C2 of the injection-molded material C.

Figure 3C:
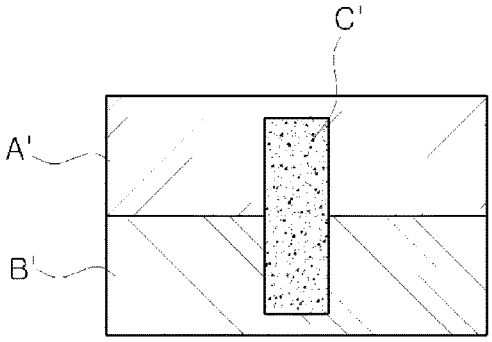
Figure 3D:
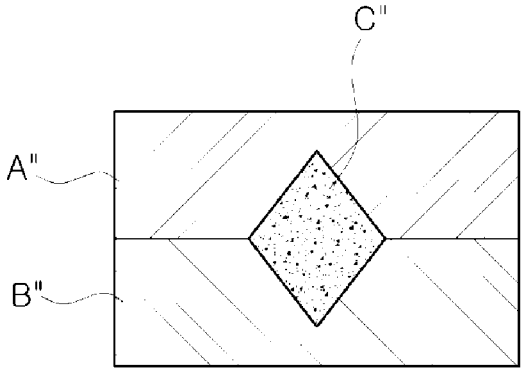

To be able to extract the injection-molded material from a cavity, the sides of an injection-molded material should be flat without protrusions. For example, FIG. 3C shows the part C' that may be removed without damage from the molds A' and B'. A part C" with laterally protruding portions is shown in FIG. 3D. However, this part can be removed without damage because the widest part is where the first mold A" and the second mold B" are in contact with each other.

A structure for integrally injection-molding the blade assembly 2 in accordance with an embodiment of the present disclosure will be described considering the relationship between a mold and an injection-molded material described above.

Figure 3E:
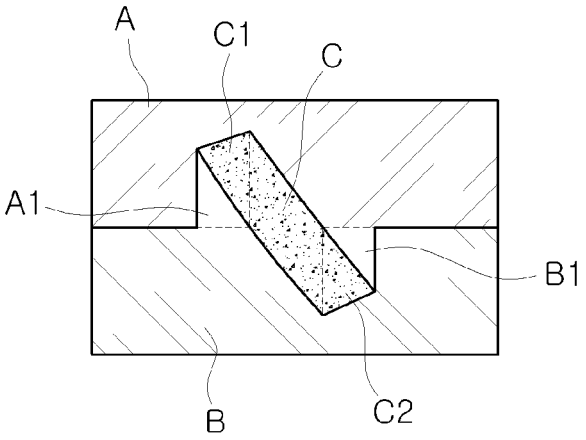
FIG. 3E is a diagram illustrating removal of injection-molded material.

FIG. 3E is a diagram illustrating removal of injection-molded material. As shown in FIGS. 3A and 3B, the injection-molded material C may not be able to be extracted. In cases like that, the first mold A and the second mold B may be modified to make extraction feasible, as shown in FIG. 3E. For example, the portion A1 may be removed from the first mold A and made to be a part of the second mold B. Accordingly, the portion C1 of the injection-molded material C will no longer block removal of the first mold A. Additionally, the portion B1 may be removed from the second mold B and made a part of the first mold A. Accordingly, the portion C2 of the injection-molded material C will no longer block removal of the injection-molded material C from the second mold B. In this manner, the first mold A may be able to be removed to expose the upper part of the injection-molded material C, and the injection-molded material C may be removed from the second mold B.

Note that this is just an example to show how a work-around may be done when molded parts are hard to remove from a mold. Various parameters may need to be considered before coming up with a solution. For example, if the first mold A and the second mold B needs to be straight across where they meet, this example would not work. In that case, a 4-part mold may be needed. The first mold A may be as above but without the section B1, and the second mold B may be as above but without the section A1. A third mold may correspond to the section A1 and a fourth mold may correspond to the section B1. Accordingly, removing the injection-molded material C may comprise removing the first mold A, then the fourth mold B1. This will allow the injection-molded material C to be removed, leaving the second mold B and the third mold A1.

This example is given purely to help make descriptions below more easy to understand.

Figure 4:
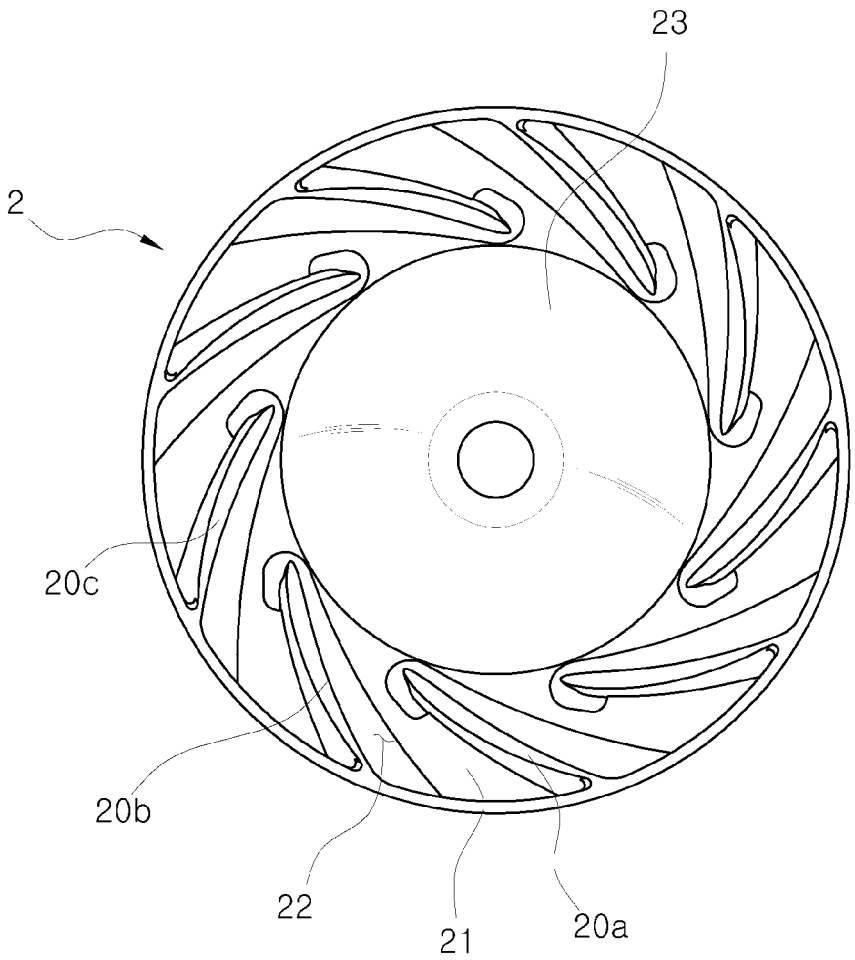
FIG. 4 is a front view of a blade assembly in accordance with an embodiment of the present disclosure.
Figure 5:
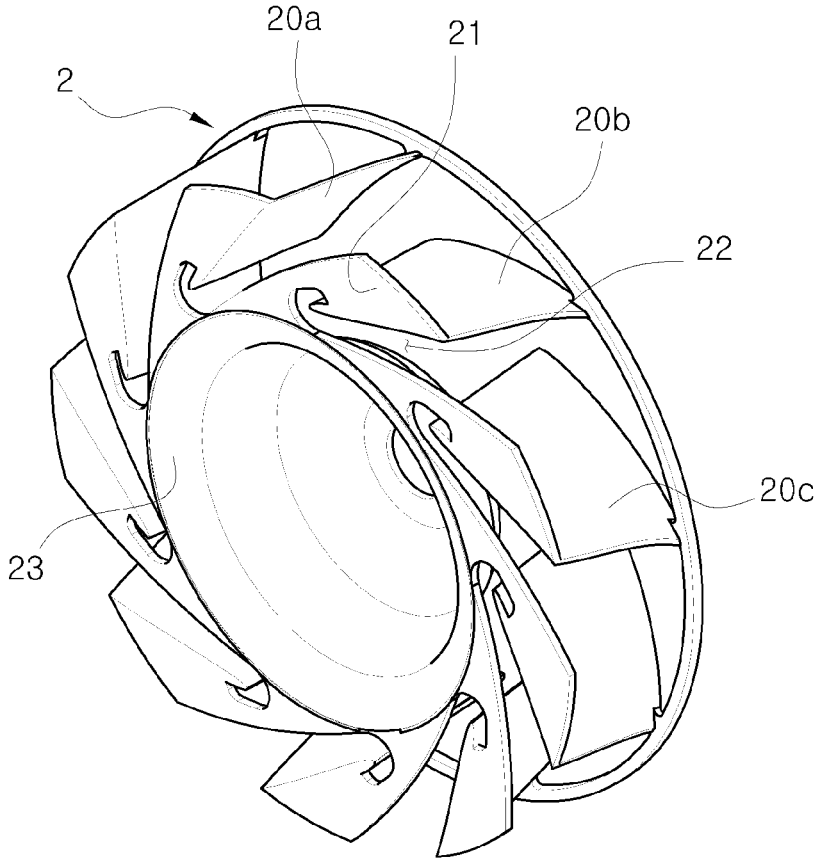
FIG. 5 is a rear view of the blade assembly in accordance with an embodiment of the present disclosure.

FIG. 4 is a front view of the blade assembly 2 in accordance with an embodiment of the present disclosure. FIG. 5 is a rear view of the blade assembly 2 in accordance with an embodiment of the present disclosure. FIG. 6 is a partial view of the blade assembly 2 in accordance with an embodiment of the present disclosure.

Referring to FIGS. 4 to 6, the opening 22 between each of the blades 20 and the fixing portion 21 may be formed in the fixing portion 21 of the blade assembly 2. The opening 22 may include a first opening 220 formed along at least a part of the surface 200*a* of the second blade 20*b* and a second opening 221 formed along at least a part of the surface 200*b* closer to the fixing portion 21.

The opening 22 may be formed to allow removal of the blades 20 with the three-dimensional shape and the fixing portion 21 are integrally injection-molded.

The mold for forming the blade assembly 2 may include a first mold and a second mold. A material of the blade assembly 2 in a form of a liquid or pellets may be injected into the cavity formed by the first mold and the second mold and heated. After applying heat for a certain time, the material is cooled. The material in the cavity may be cured to a shape corresponding to the cavity of the mold. After the cooling is performed, the first mold may be removed upward. The blade assembly 2 is then extracted from the second mold. The extracted blade assembly 2 may be further cooled.

The cavity formed to correspond to the shape of the blade assembly 2 may be formed by the first mold and the second mold in such a way that one part of the blade assembly 2 may be formed in the first mold and another part may be formed in the second mold.

Similarly to the descriptions regarding FIGS. 3A to 3C, for the top mold the blade assembly 2 should not be wider in an upper part than in a lower part, and for the bottom mold, the blade assembly 2 should not be wider in a lower part than in an upper part. The top mold and the bottom mold may together be referred to as the mold.

Hereinafter, an example describes the second blade 20*b* when the front of the blade assembly 2 is in the top mold and the rear of the blade assembly 2 is in the bottom mold. A front of a hub end of the second blade 20*b* located near the hub 23 is formed to be curved to face the first direction D1 where the third blade 20*c* is located, and a rear of a outer end is formed to be curved to face the second direction D2 where the first blade 20*a* is located. Since part of the front of the hub end 201 of the second blade 20*b* or part of the rear of the outer end 202 protrudes laterally, the fixing portion 21 and the second blade 20*b* may be difficult to separate from the mold. Such a problem may similarly occur for all the blades 20.

To allow the blade assembly 2 to be integrally injection-molded and separated from the mold, the opening 22 may be formed in the fixing portion 21. The opening 22 is formed in the fixing portion 21, thereby providing a space that allows the blades 20 and the fixing portion 21 to be integrally injection-molded and separated from the mold.

When viewed from the front of the blades 20 through the opening 22, a plane where the hub end 201 of the second blade 20*b* that curves toward the first direction D1 and the fixing portion 21 overlaps and which extends at a right angle from one surface of the blade 20 may be referred to as a first reference plane P1. Here, the first reference plane P1 may be an area through which the blade assembly 2 may be extracted from the mold when injection-molded and may correspond to an area before a direction in which the second blade 20*b* is curved from the hub end 201 thereof changes from a first direction to a second direction in which a part of the blade 20 overlaps with the fixing portion 21.

A definition of the first reference plane P1 may be similarly applied to following embodiments corresponding to FIGS. 9 to 22.

The outer end 202 of the blade 20 curved toward the second direction D2 may deviate from the first reference plane P1. The part of the outer end 202 that deviates from the first reference plane P1 and overlaps with the plane that extends at a right angle from the one surface of the blade 20 may be referred to as a second reference plane P2. A partial area of the fixing portion 21 corresponding to the second reference plane P2 may be provided in an open shape.

As described above, the partial area of the fixing portion 21 corresponding to the second reference plane P2 is provided to be open, thereby allowing the mold to pass by a part corresponding to the opening 22 when the blade assembly 2 is injection-molded. Accordingly, even when there is a part that protrudes laterally from the first reference plane P1 due to the three-dimensional shape of the blade 20, the blades 20 and the fixing portion 21 may be integrally injection-molded and separated from the mold.

The opening 22, as shown in FIG. 6, may include the first opening 220 provided in the first direction D1 and the second opening 221 provided in the second direction D2. When viewed from the front of the blade assembly 2, the first opening 220 or the second opening 221 may be identical to or larger than an area of the fixing portion 21 that overlaps with the part protruding in the first direction D1 or the second direction D2 from the first reference plane P1.

The first opening 220 may include an open part where the part that protrudes from the first reference plane P1 in the first direction D1 and the fixing portion 21 overlap. The second opening 221 may include an open part where the part that protrudes from the first reference plane P1 in the second direction D2 and the fixing portion 21 overlap. The first opening 220 and the second opening 221 may be connected to form one opening. The first opening 220 and the second opening 221 may be formed to be adjacent to the surface 200*a* and a part of the surface 200*b*, respectively. The opening 22 may have a shape similar to a hook.

As described above, since there is the opening 22 between a fixing portion 21 to another fixing portion 21 adjacent to it, when the blade assembly 2 is integrally injection-molded, even though the blade 20 has the three-dimensional twisted shape, the blade assembly 2 may be able to be extracted from the mold.

Figure 7:
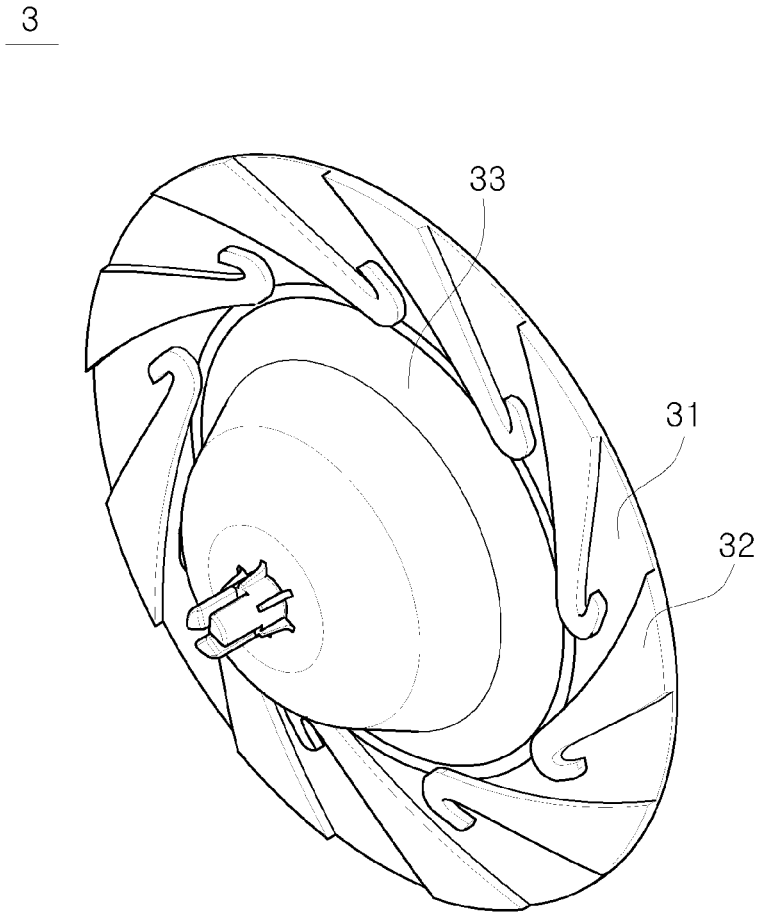
FIG. 7 is a view illustrating a hub plate in accordance with an embodiment of the present disclosure.
Figure 8:
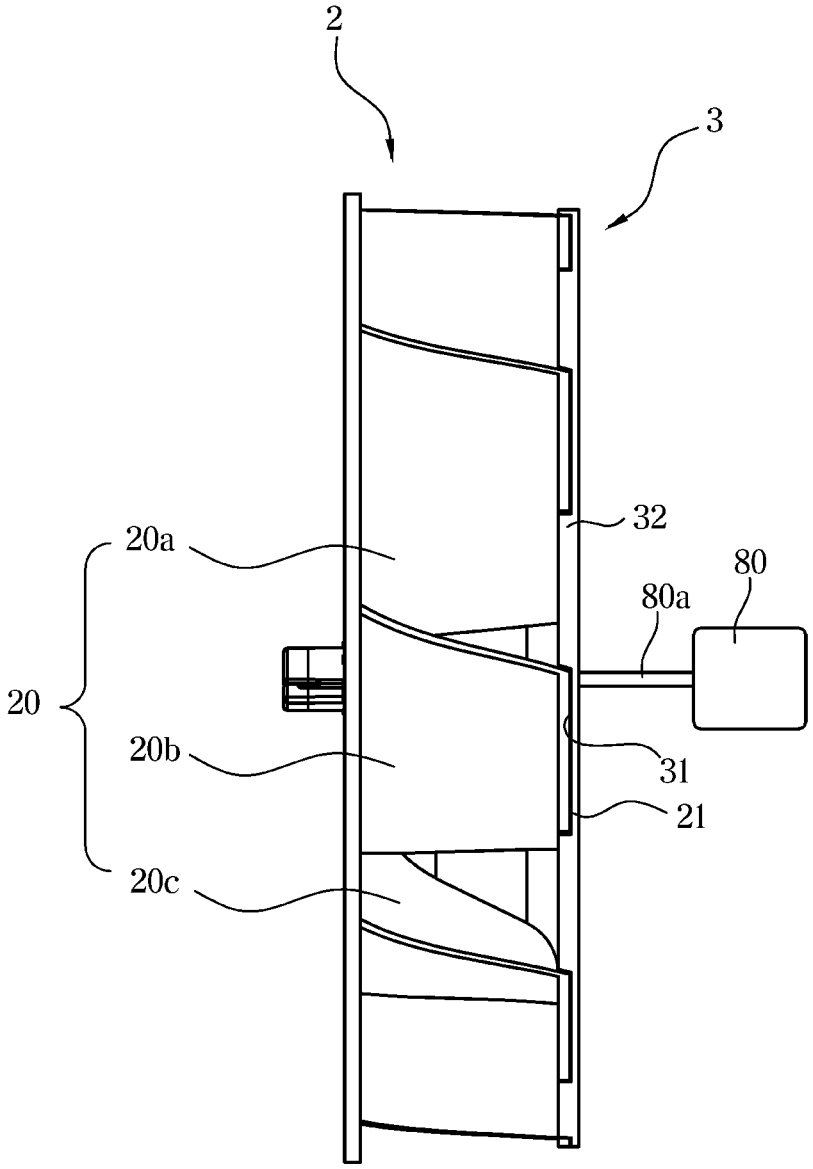
FIG. 8 is a side view of the centrifugal fan assembly in accordance with an embodiment of the present disclosure.

FIG. 7 is a view illustrating the hub plate 3 in accordance with an embodiment of the present disclosure. FIG. 8 is a side view of the centrifugal fan assembly 1 in accordance with an embodiment of the present disclosure.

Referring to FIGS. 7 and 8, the hub plate 3 may include the concave portion 31, the convex portion 32, and the hub 33. The hub 33 may correspond to the hub 23 in the blade assembly 2. The hub plate 3 may be integrally injection-molded.

The shape of the convex portion 32 may correspond to the shape of the opening 22 in the blade assembly 2. The fixing portion 21 may be inserted into the concave portion 31 and then welded to the concave portion 31. The forward surface of the convex portion 32 and the forward surface of the fixing portion 21 may then form a plane.

As described above, the fixing portion 21 is inserted into and welded to the concave portion 31 of the hub plate 3, thereby coupling the blade assembly 2 with the hub plate 3. Also, the convex portion 32 and the fixing portion 21 form a plane, thereby reducing friction from the air flowing by the hub plate 3 while the centrifugal fan assembly 1 is operating.

Figure 9:
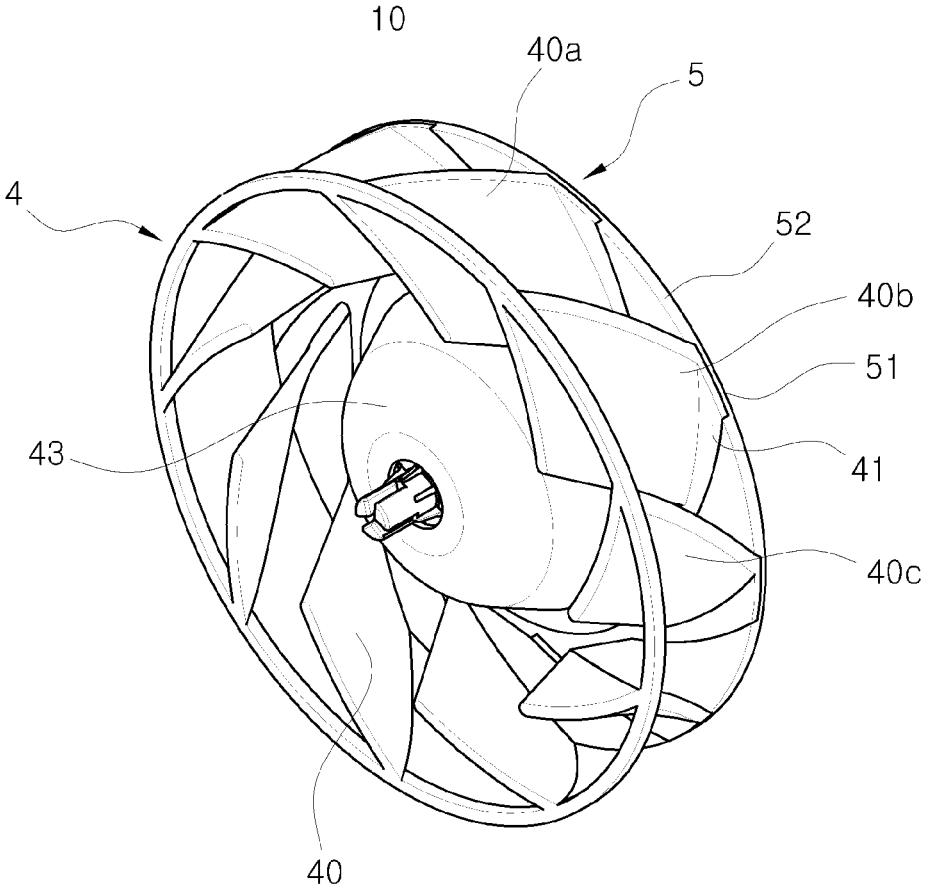
FIG. 9 is a perspective view of a centrifugal fan assembly in accordance with an embodiment of the present disclosure.
Figure 10:
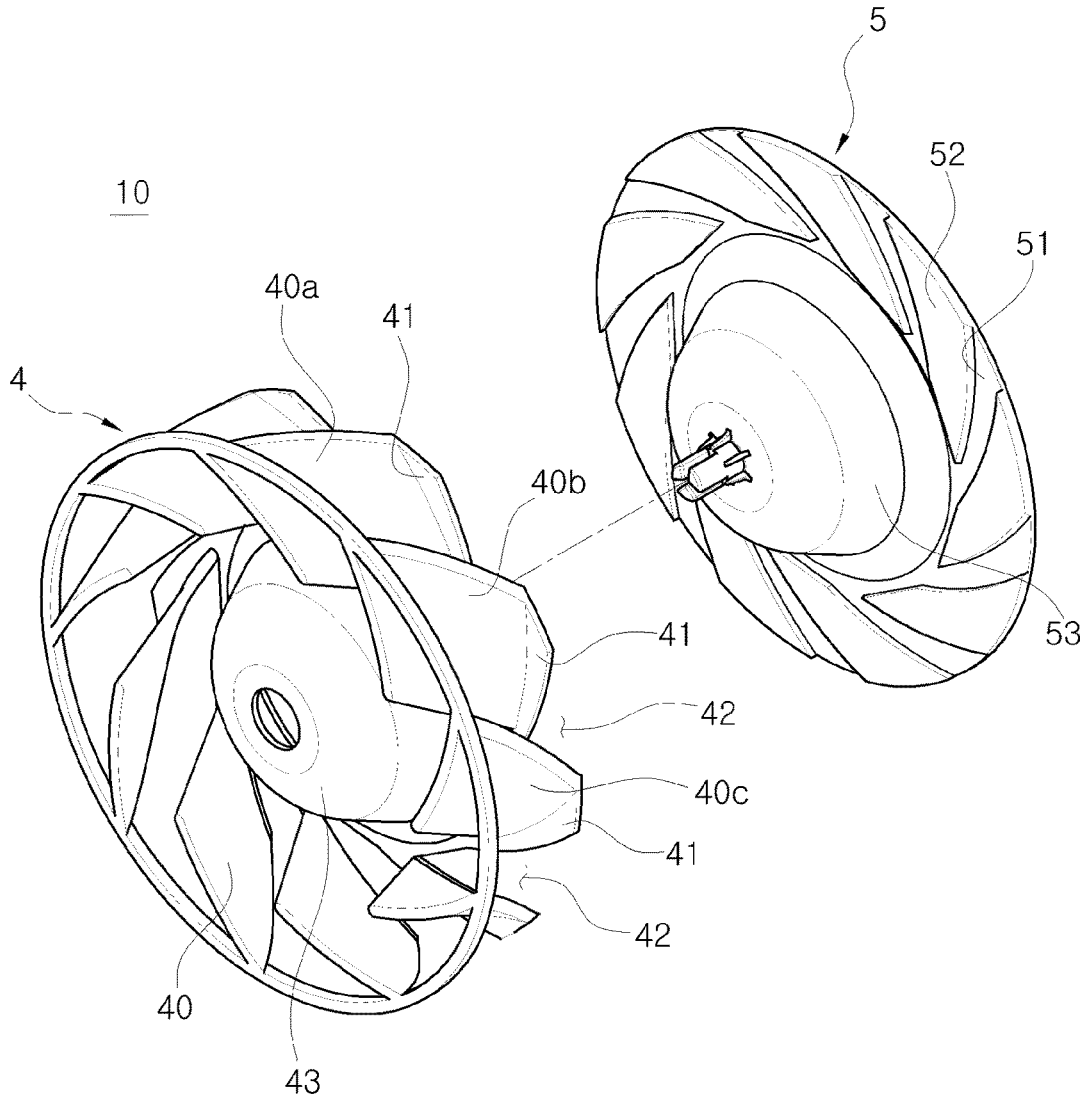
FIG. 10 is an exploded perspective view of the centrifugal fan assembly in accordance with an embodiment of the present disclosure.

FIG. 9 is a perspective view of a centrifugal fan assembly 10 in accordance with an embodiment of the present disclosure. FIG. 10 is an exploded perspective view of the centrifugal fan assembly 10 in accordance with an embodiment of the present disclosure.

Referring to FIGS. 9 and 10, the centrifugal fan assembly 10 may include a blade assembly 4 and a hub plate 5. The blade assembly 4 may be installed in front of the hub plate 5. A fan motor (motor 80 in FIG. 8) may be installed in the rear of the hub plate 5 to transfer torque to the centrifugal fan assembly 10 (via shaft 80*a* in FIG. 8).

Various embodiments of the present disclosure may have the components of the centrifugal fan assembly 1 similarly applied to other components of the centrifugal fan assembly 10 in addition to a fixing portion 41 and an opening 42 of the blade assembly 4 and a concave portion 51 and a convex portion 52 of the hub plate 5.

In detail, the blade assembly 4 includes blades 40 located at regular intervals around a hub 43 located at the center of the blade assembly 4. At least some of the blades 40 may have a curved shape.

The blade assembly 4 includes the fixing portion 41 that connects hub 43 with the blades 40, and fixing portion 41 may be welded to the hub plate 5. The opening 42 may be formed in the fixing portion 41. The blades 40, the fixing portion 41, and the hub 43 may be integrally injection-molded.

Each of the blades 40 provided in the blade assembly 4 may be provided as a three-dimensional shape to reduce formation of eddies on sides of the blades 40.

For example, the blades 40 may be provided to have a three-dimensional twisted shape where one end of a blade may be curved toward a first direction where an adjacent blade of the blades 40 is located and another end may be curved toward an opposite direction where another adjacent blade of the blades 40 is located.

The blades 40 may include a first blade 40*a*, a second blade 40*b*, and a third blade 40*c*. The first blade 40*a*, the second blade 40*b*, and the third blade 40*c* may be located at regular intervals in a clockwise direction. A hub end 401 of the second blade 40*b* may be curved to face a first direction D3 in which the first blade 40*a* is located and an outer end 402 of the second blade 40*b* may be curved to face a second direction D4 in which the third blade 40*c* is located. The hub end 401 and the outer end 402 of the second blade 40*b* may be located on a diagonal line of the second blade 40*b*.

The blade assembly 4 may include the fixing portion 41 installed on the hub plate 5. The blades 40 may be at right angles with the fixing portion 41. For example, the opening 42 may be formed in the fixing portion 41 located near the second blade 40*b*. The opening 42 is formed as part of integrally injection-molding the blades 40 and the fixing portion 41.

The blade assembly 4 may be installed on the hub plate 5. A hub 53 may be in a center of the hub plate 5. The hub 53 may correspond to the hub 43 provided in the blade assembly 4.

The concave portion 51 and the convex portion 52 may be formed on the hub plate 5. The concave portion 51 may correspond to a shape of the fixing portion 41 in the blade assembly 4. Accordingly, the fixing portion 41 of the blade assembly 4 may be fixedly inserted into the concave portion 51, and the forward surface of the fixing portion 41 and the forward surface of the convex portion 52 may form the same plane. The fixing portion 41 may be welded to the concave portion 51.

Figure 11:
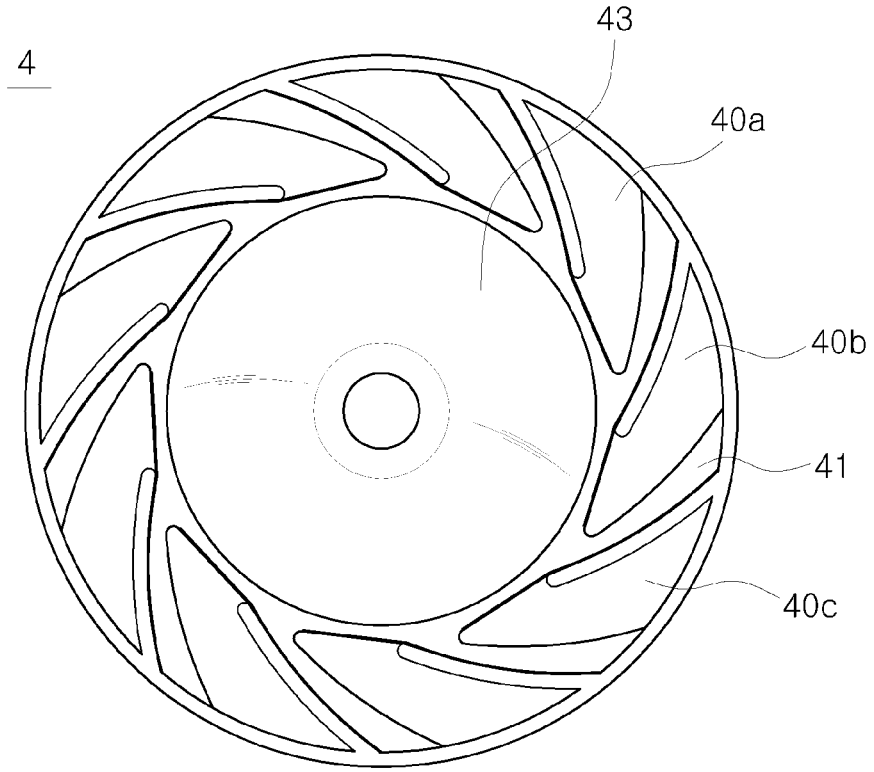
FIG. 11 is a front view of a blade assembly in accordance with an embodiment of the present disclosure.
Figure 12:
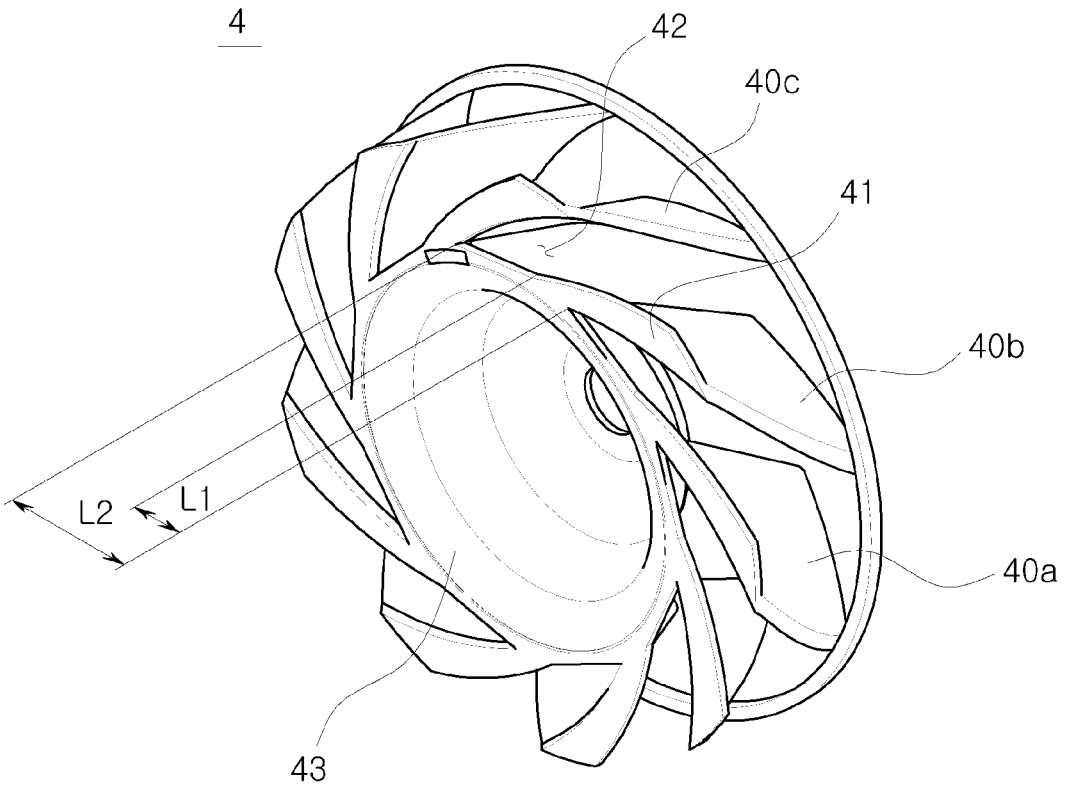
FIG. 12 is a rear view of the blade assembly in accordance with an embodiment of the present disclosure.
Figure 13:
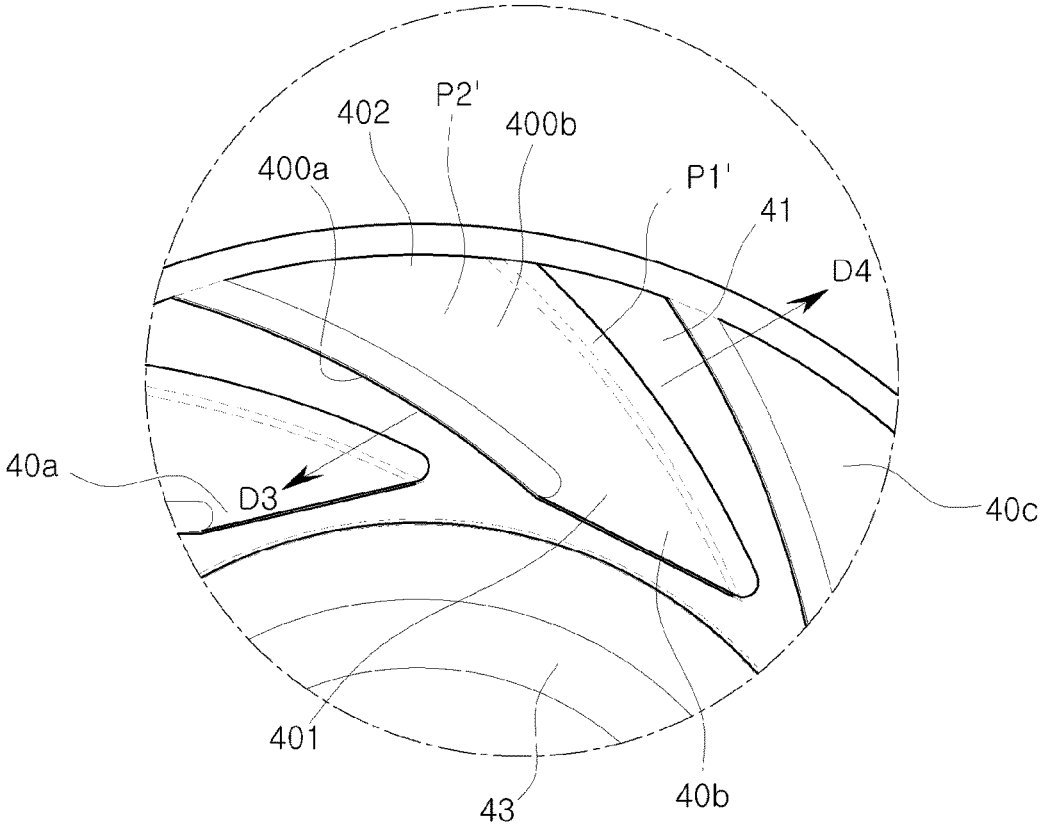
FIG. 13 is a partial view of the blade assembly in accordance with an embodiment of the present disclosure.

FIG. 11 is a front view of the blade assembly 4 in accordance with an embodiment of the present disclosure. FIG. 12 is a rear view of the blade assembly 4 in accordance with an embodiment of the present disclosure. FIG. 13 is a partial view of the blade assembly 4 in accordance with an embodiment of the present disclosure.

Referring to FIGS. 11 to 13, the blade assembly 4 may include the fixing portion 41 that may be used to install the blade assembly 4 on to the hub plate 5. The fixing portion 41 may extend from each of the blades 40 in one direction. In detail, the fixing portion 41 may extend from the hub end 401 of each of the blades 40 toward a front of one surface. The fixing portion 41 that extends from each of the blades 40 may be on the same plane.

The blades 40 may include the first blade 40*a*, the second blade 40*b* adjacent to the first blade 40*a*, and the third blade 40*c* adjacent to the second blade 40*b*. The first blade 40*a*, the second blade 40*b*, and the third blade 40*c* may be sequentially located in a clockwise direction.

The opening 42 may be provided between each pair of adjacent blades of the blades 40. The fixing portion 41 located between each pair of adjacent blades of the blades 40 is shorter than a distance between each pair of adjacent blades of the blades 40, thereby providing the opening 42.

For example, an extension length L1 of the fixing portion 41 that extends from the second blade 40*b* may be shorter than a length L2 from the hub end 401 of the second blade 40*b* to the hub end 401 of the third blade 40*c* adjacent to the second blade 40*b*. The opening 42 may be provided between the fixing portion 41 and the first blade 40*a*.

When the blades 40 in the three-dimensional shape and the fixing portion 41 are integrally injection-molded, the blades 40 may be extracted from the mold due to the opening 42, which may correspond to each of the blades 40.

As shown in FIG. 13, when viewed from the front of the blades 40, a first reference plane P1' may be an area where the fixing portion 41 overlaps with a flat plane and a part of the blade 40*b*. In general, a part in which a blade of the blades 40 deviates from its first reference plane P1' may be referred to as a second reference plane P2'. The opening 42 may be provided to not allow the second reference plane P2' to overlap with the fixing portion 41. That is, the opening 42 may be formed in the fixing portion 41 to prevent a surface that deviates from the first reference plane P1' and overlap with a blade of the blades 40 from existing.

The opening 42 may be a shape where a partial area of the fixing portion 41 overlaps with a part that protrudes laterally from the first reference plane P1". Accordingly, even when a part protrudes laterally from the first reference plane P1' due to the three-dimensional shape of the blades 40, the blades 40 and the fixing portion 41 may be integrally injection-molded and separated from the mold.

The blades 40 included in the blade assembly 4 in accordance with an embodiment of the present disclosure may be provided in a shape similar to the blades 20 included in the blade assembly 2.

That is, a front of the hub end 401 of the second blade 40*b* located near the hub 43 may be bent to face the first direction D3 where the third blade 40*c* is located and a rear of the outer end 402 may be bent to face the second direction D4 where the first blade 40*a* is located. In this case, since part of the front of the hub end 401 of the second blade 40*b* and part of the rear of the outer end 402 are curved to face different directions, the fixing portion 41 and the second blade 40*b* may be difficult to integrally injection-mold and separate from the mold.

To allow the blade assembly 4 to be integrally injection-molded and removed from the mold, the opening 42 may be formed in the fixing portion 41. The opening 42 is formed in the fixing portion 41, thereby providing a space that allows the blades 40 and the fixing portion 41 to be integrally injection-molded and removed from the mold.

In the case of the opening 42, when an area in which the fixing portion 41 and a partial surface of, for example, the blade 40*b* overlaps when viewed from the front of the blades 40 is referred to as a first reference plane P1', an area located in the rear of the part of the blade 40, which protrudes laterally from the first reference plane P1' on the same plane as the first reference plane P1', may be referred to as the second reference plane P2'. The fixing portion 41 corresponding to the second reference plane P2' may be open. Since due to the opening 42 when the blade assembly 4 is injection-molded, even when the part that protrudes laterally from the first reference plane P1' due to the three-dimensional shape of each of the blades 40 is present, the blades 40 and the fixing portion 41 may be integrally injection-molded and removed from the mold. A size of the opening 42 may be formed to have the same area as the second reference plane P2' or may be provided larger than the second reference plane P2'.

Figure 14:
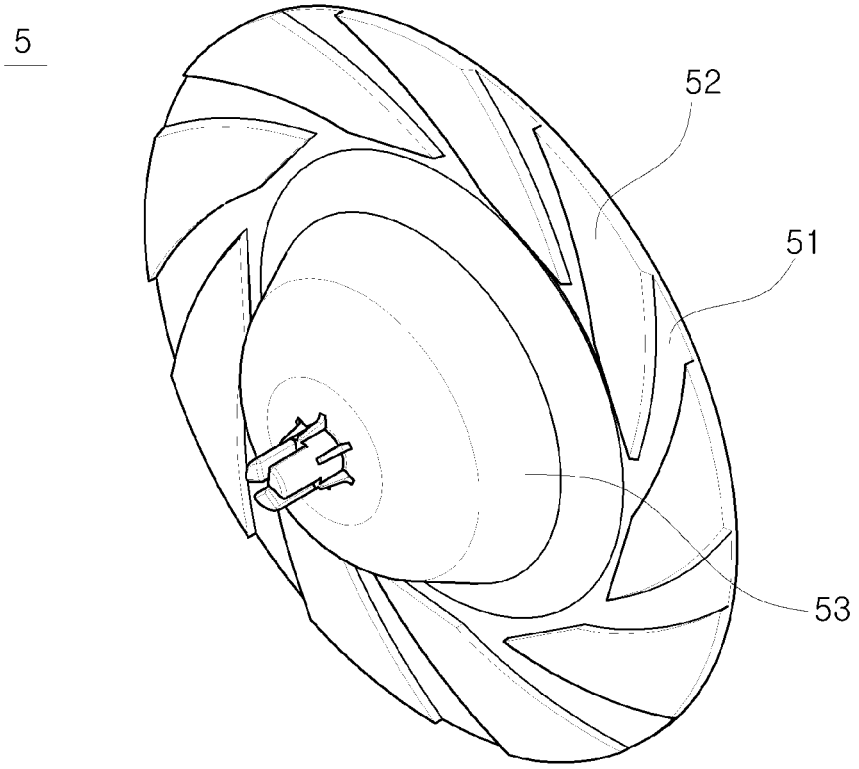
FIG. 14 is a view illustrating a hub plate in accordance with an embodiment of the present disclosure.
Figure 15:
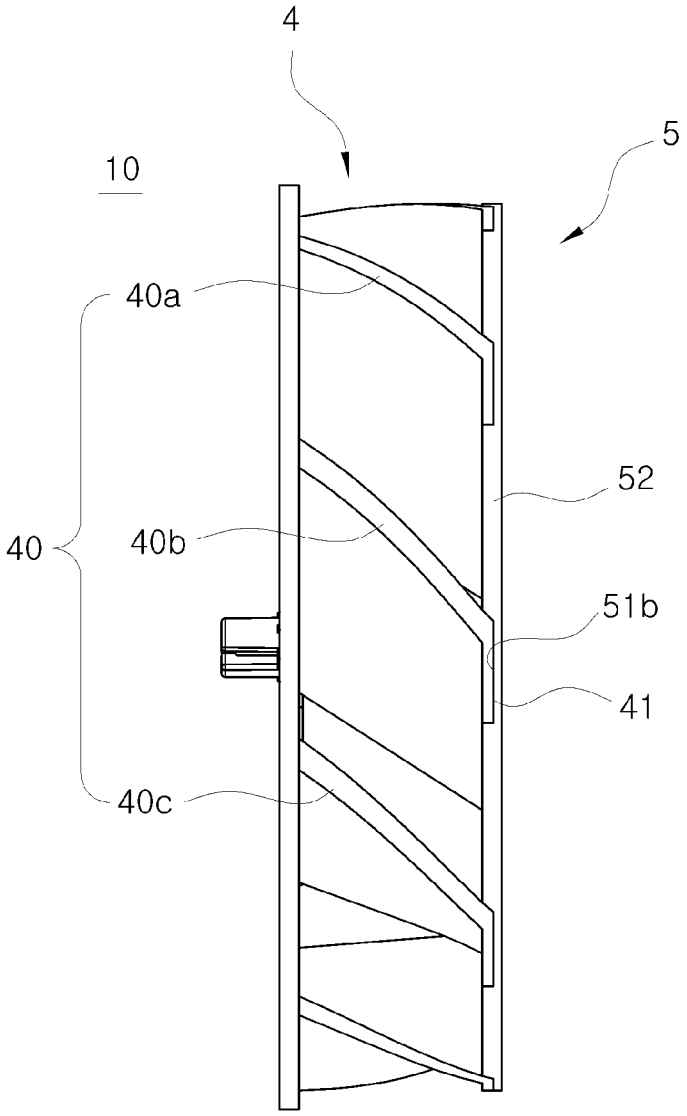
FIG. 15 is a side view of the centrifugal fan assembly in accordance with an embodiment of the present disclosure.

FIG. 14 is a view illustrating the hub plate 5 in accordance with an embodiment of the present disclosure. FIG. 15 is a side view of the centrifugal fan assembly 10 in accordance with an embodiment of the present disclosure.

Referring to FIGS. 14 and 15, the hub plate 5 may include the concave portion 51, the convex portion 52, and the hub 53 in the center. The hub 53 of the hub plate 5 may correspond to the hub 43 of the blade assembly 4. The hub plate 5 may be integrally injection-molded.

A shape of the convex portion 52 formed on the hub plate 5 may correspond to the shape of the opening 42 provided in the blade assembly 4. The fixing portion 41 may be inserted into and welded to the concave portion 51, and the forward surface of the convex portion 52 and the forward surface of the fixing portion 41 may form a plane.

As described above, the fixing portion 41 is inserted into and welded to the concave portion 51 of the hub plate 5, thereby coupling the blade assembly 4 with the hub plate 5.

Also, the forward surface of the convex portion 52 and the forward surface of the fixing portion 41 form the same plane, thereby reducing friction from the air flowing by the hub plate 5 while the centrifugal fan assembly 10 is operating.

Figure 16:
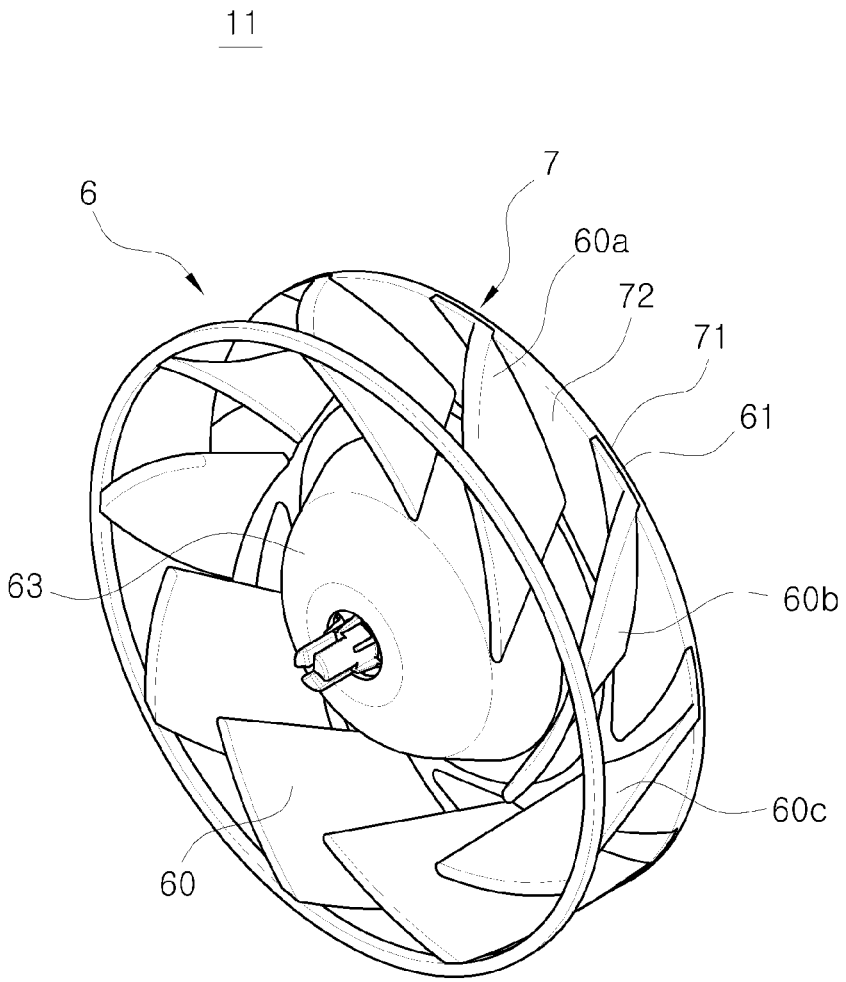
FIG. 16 is a perspective view of a centrifugal fan assembly in accordance with an embodiment of the present disclosure.
Figure 17:
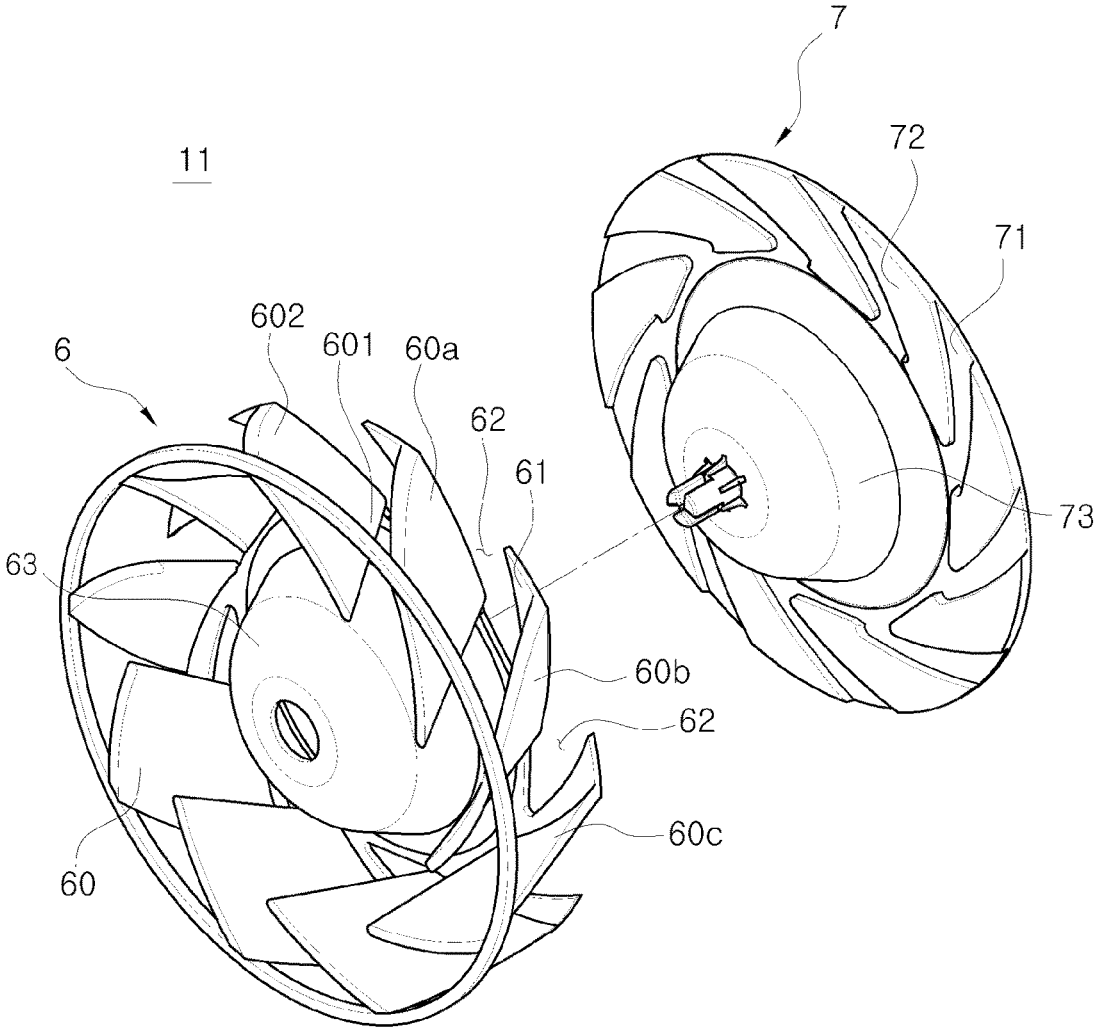
FIG. 17 is an exploded perspective view of the centrifugal fan assembly in accordance with an embodiment of the present disclosure.

FIG. 16 is a perspective view of a centrifugal fan assembly 11 in accordance with an embodiment of the present disclosure. FIG. 17 is an exploded perspective view of the centrifugal fan assembly 11 in accordance with an embodiment of the present disclosure.

Referring to FIGS. 16 and 17, the centrifugal fan assembly 11 may include a blade assembly 6 and a hub plate 7. The blade assembly 6 may be installed in front of the hub plate 7. A fan motor (motor 80 in FIG. 8) may be installed in the rear of the hub plate 7 to transfer torque to the centrifugal fan assembly 11 (via shaft 80*a* in FIG. 8).

The components of the centrifugal fan assembly 1 may be similarly applied to other components of the centrifugal fan assembly 11 in addition to a fixing portion 61 and an opening 62 of the blade assembly 6, and a concave portion 71 and a convex portion 72 of the hub plate 7.

In detail, the blade assembly 6 includes a hub 63 at the center with the blades 60 provided around the hub 63 at regular intervals. At least some of the blades 60 may have a curved shape.

The blade assembly 6 includes the fixing portion 61 that connects the hub 63 with the blades 60 and is inserted into and welded to the hub plate 7. The opening 62 may be formed in the fixing portion 61. The blades 60, the fixing portion 61, and the hub 63 may be integrally injection-molded.

Each of the blades 60 provided in the blade assembly 6 may be provided as a three-dimensional shape to reduce formation of eddies on one side of the blades 60.

For example, the blades 60 may have a three-dimensional shape where one end is bent in one direction and another end is bent in another direction. That is, the hub end 601 of the blades 60 may be curved to face an adjacent blade of the blades 60 and the outer end 602 may be curved to face still another adjacent blade of the blades 60. The curved portions of the hub end 601 and the outer end 602 of the blades 60 may be located on a diagonal line.

The blades 60 may include a first blade 60*a*, a second blade 60*b*, and a third blade 60*c*. The first blade 60*a*, the second blade 60*b*, and the third blade 60*c* may be at regular intervals and sequentially located in a clockwise direction. Here, the second blade 60*b* may be curved to allow at least part of the hub end 601 to face the third blade 60*c* and to allow at least part of the outer end 602 to face the first blade 60*a*.

Figure 20:
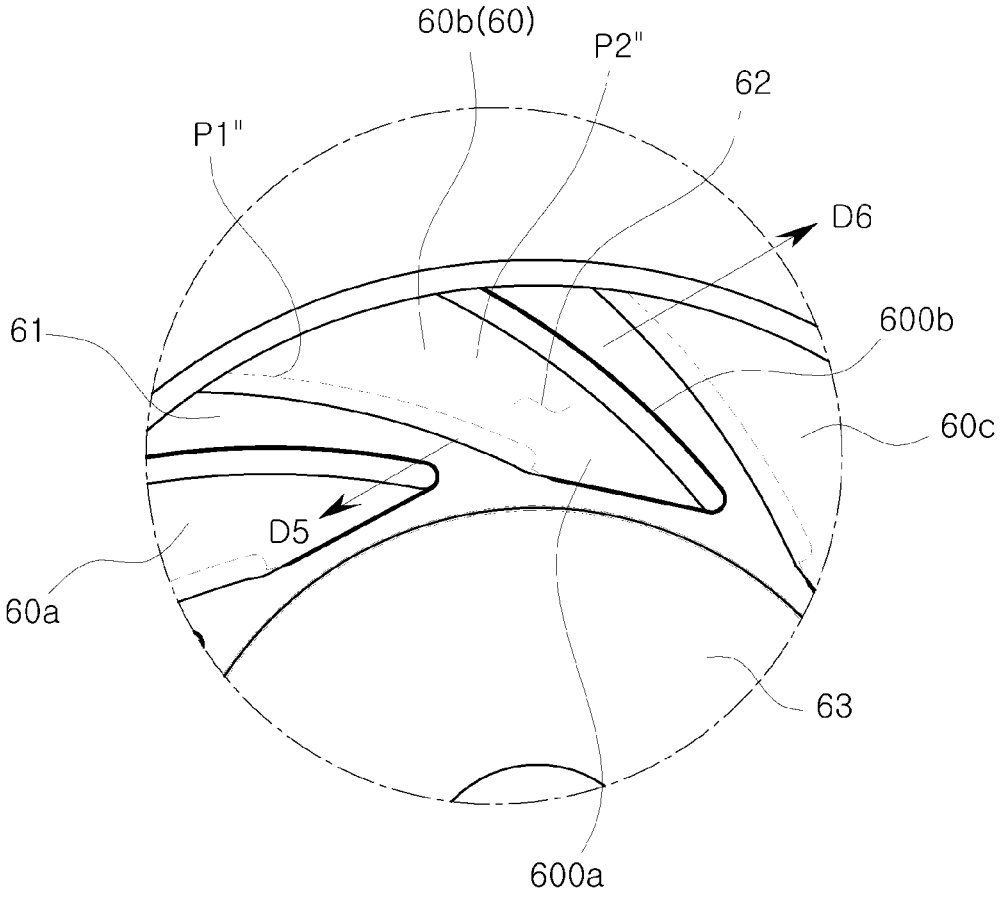
FIG. 20 is a partial view of the blade assembly in accordance with an embodiment of the present disclosure.

As shown in FIG. 20, a direction toward the first blade 60*a* located in front of the surface 600*a* of the second blade 60*b* may be referred to as a first direction D5 and a direction toward the third blade 60*c* located in front of another surface 600*b* of the second blade 60*b* may be referred to as a second direction D6.

The blade assembly 6 may include the fixing portion 61 installed on the hub plate 7. The blades 60 may be at right angles to the fixing portion 61. For example, the opening 62 may be formed in the fixing portion 61 located near the second blade 60*b*. The opening 62 is provided by being integrally injection-molded with the blades 60 and the fixing portion 61.

The blade assembly 6 may be installed on the hub plate 7. A hub 73 may be provided in a center of the hub plate 7. The hub 73 may correspond to the hub 63 in the blade assembly 6.

The concave portion 71 and the convex portion 72 may be provided on the hub plate 7. The concave portion 71 may correspond to a shape of the fixing portion 61 in the blade assembly 6. The fixing portion 61 of the blade assembly 6 may be fixedly inserted into the concave portion 71 so that a surface of the fixing portion 61 and a surface of the convex portion 72 may form the same plane. The fixing portion 61 may be inserted into and fixed to the concave portion 71. For example, the fixing portion 61 may be inserted into and welded to the concave portion 71.

Figure 18:
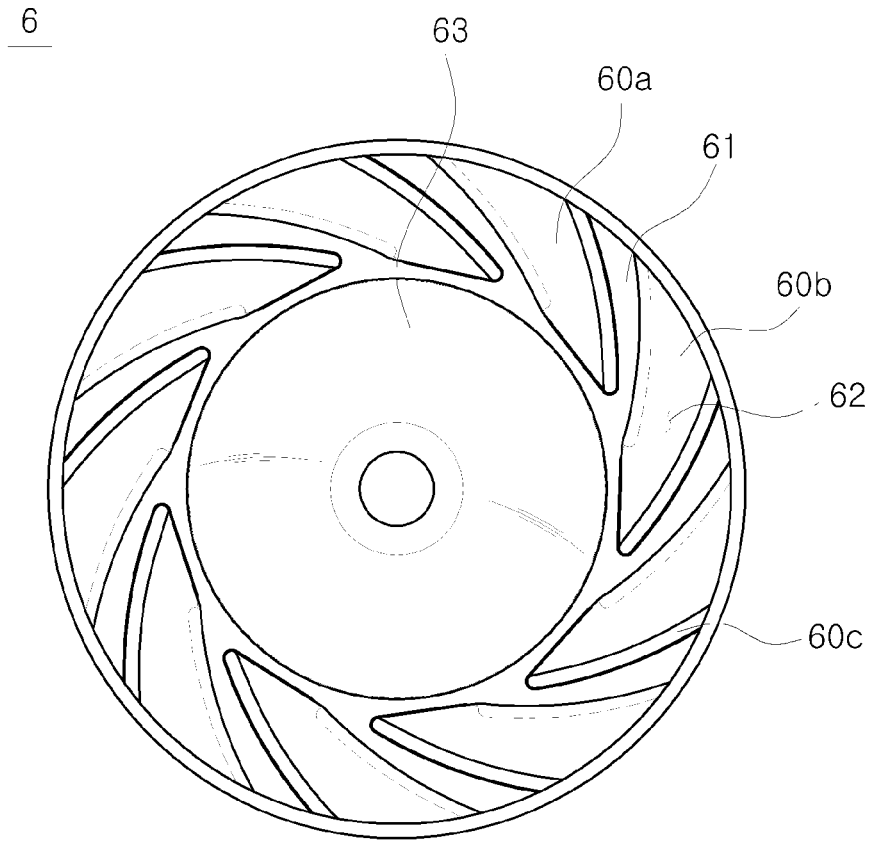
FIG. 18 is a front view of the blade assembly in accordance with an embodiment of the present disclosure.
Figure 19:
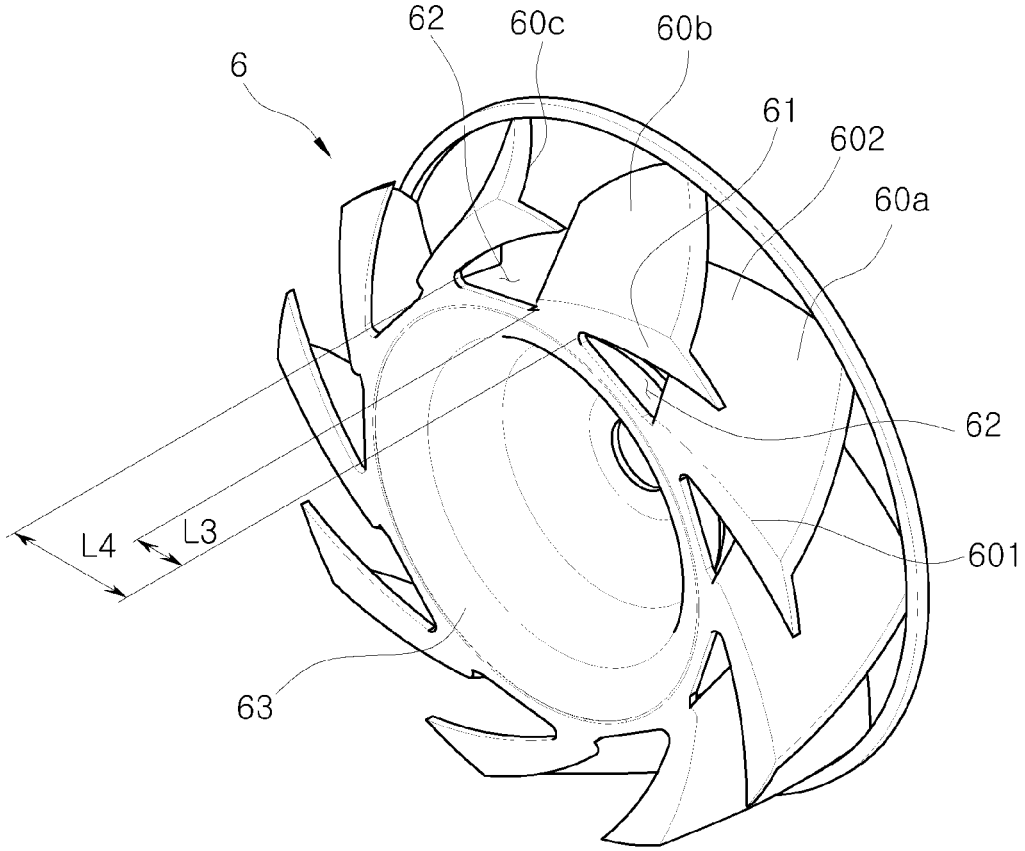
FIG. 19 is a rear view of the blade assembly in accordance with an embodiment of the present disclosure.

FIG. 18 is a front view of the blade assembly 6 in accordance with an embodiment of the present disclosure. FIG. 19 is a rear view of the blade assembly 6 in accordance with an embodiment of the present disclosure. FIG. 20 is a partial view of the blade assembly 6 in accordance with an embodiment of the present disclosure.

Referring to FIGS. 18 to 20, the blade assembly 6 may include the fixing portion 61 that may be installed on the hub plate 7. The fixing portion 61 may extend from the blades 60 in one direction. In detail, the fixing portion 61 may extend from one end of each of the blades 60 toward a front of one surface. The fixing portion 61 which extend from the blades 60 may be located on the same plane.

In the case of the blade assembly 6 and the hub plate 7 in accordance with an embodiment of the present disclosure, the content of the centrifugal fan assembly 10 may be similarly applied, except for the shapes of the fixing portion 61, the opening 62 in the blade assembly 6, and the shapes of the concave portion 71 and the convex portion 72 in the hub plate 7.

In detail, the blades 60 may include the first blade 60*a*, the second blade 60*b* adjacent to the first blade 60*a*, and the third blade 60*c* adjacent to the second blade 60*b*. The first blade 60*a*, the second blade 60*b*, and the third blade 60*c* may be sequentially located in a clockwise direction.

The opening 62 may be provided between each pair of adjacent blades of the blades 60. In the blade assembly 6 in accordance with another embodiment of the present disclosure, a length L3 of the fixing portion 61 is shorter than a distance L4 between each pair of the blades 60, thereby providing the opening 62.

For example, an extension length L3 of a fixing portion 61 which extends from the second blade 60*b* may be shorter than a length L4 from a hub end 601 of the second blade 60*b* to a corresponding position of the hub end 602 of the third blade 60*c* adjacent to the second blade 60*b*. The opening 62 may be provided between the fixing portion 61 and the first blade 60*a*.

Due to the opening 62, the blades 60 having a three-dimensional shape and the fixing portion 61 may be integrally injection-molded and removed from the mold.

An area in which a part of the blades 60 and the fixing portion 61 are overlapped with each other when the blades 60 is viewed from the front may be referred to as a first reference plane P1". The first reference plane P1" may be from the outer end 602 of the blade 60 to a center of the blade 60. An area corresponding to the blades 60 that protrudes from the first reference plane P1" on the same plane as the first reference plane P1" may be referred to as a second area P2".

The opening 62 may be provided in a shape in which a partial area of the fixing portion 61 overlapped with a part which protrudes laterally from the first reference plane P1" is open. Since the mold may pass by a part corresponding to the opening 62 when the blade assembly 6 is injection-molded, even when the part which protrudes laterally from the first reference plane P1" due to the three-dimensional shape of the blades 60 is present, the blades 60 and the fixing portion 61 may be integrally injection-molded and removed from the mold.

The opening 62 located near the hub 63 may include an inclined portion 620 which is bent toward an inside of the blades 60. As described above, due to a shape in which the opening 62 located near the hub 63 is more open toward the inside of the blades 60, that is, the inclined portion 620, the blade assembly 6 and the hub plate 7 may be more tightly coupled.

The blades 60 included in the blade assembly 6 in accordance with an embodiment of the present disclosure may be provided in a shape similar to the blades 20 included in the blade assembly 2 in accordance with an embodiment of the present disclosure.

That is, the second blade 60*b* is formed to be curved to allow the hub end 601 located near the hub 63 to face the first direction D5 where the third blade 60*c* is located and to allow a rear of the outer end 602 to face the second direction D6 where the first blade 60*a* is located. Here, the hub end 601 and the outer end 602 of the second blade 60*b* may be located on a diagonal line. Since the second blade 60*b* has curved and twisted shape, the fixing portion 61 and the second blade 60*b* may be difficult to remove from a mold after being integrally injection-mold.

To allow the blade assembly 6 to be integrally injection-molded and removed from the mold, the opening 62 may be formed in the fixing portion 61. The opening 62 formed in the fixing portion 61 provides a space that allows the blades 60 and the fixing portion 61 to be integrally injection-molded and removed from the mold.

In the case of the opening 62, when an area in which the fixing portion 61 and a part of each of the blades 60 overlap when viewed from the front of the blades 60 is referred to as the first reference plane P1", a part that protrudes laterally from the first reference plane P1" on the same plane as the first reference plane P1" may be referred to as the second reference plane P2". A part of the fixing portion 61 that overlaps with the second reference plane P2" may be provided in an open shape. Since the mold may pass by a part corresponding to the opening 62 when the blade assembly 6 is injection-molded, even when a part that protrudes laterally from the first reference plane P1" due to the three-dimensional shape of the blades 60 is present, the blades 60 and the fixing portion 61 may be integrally injection-molded and removed from the mold.

Figure 21:
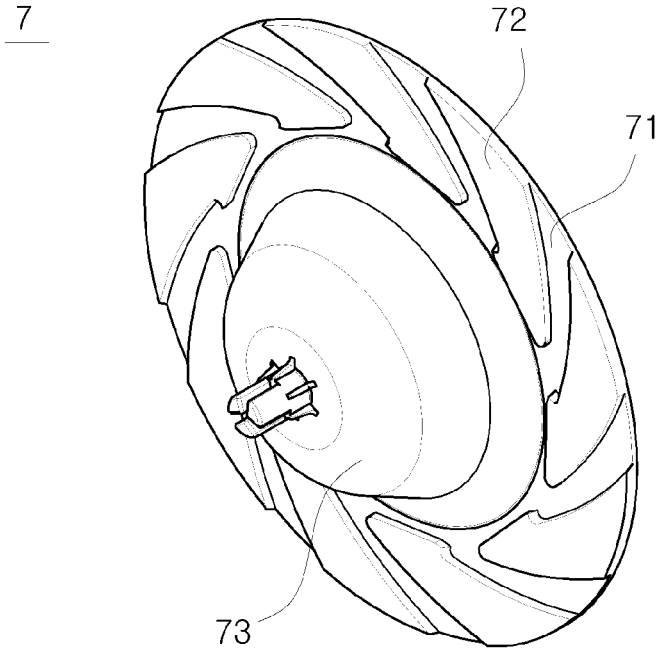
FIG. 21 is a view of a hub plate in accordance with an embodiment of the present disclosure.
Figure 22:
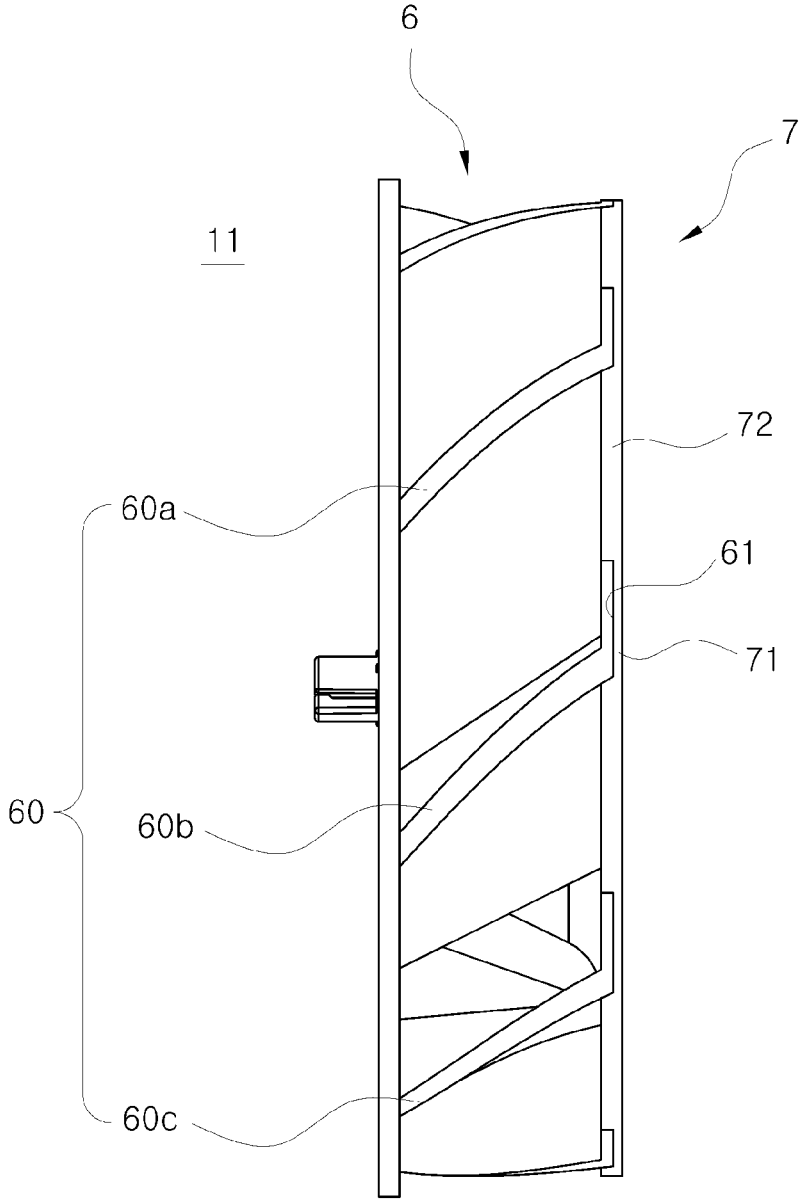
FIG. 22 is a side view of the centrifugal fan assembly in accordance with an embodiment of the present disclosure.

FIG. 21 is a view of the hub plate 7 in accordance with an embodiment of the present disclosure. FIG. 22 is a side view of the centrifugal fan assembly 11 in accordance with an embodiment of the present disclosure.

Referring to FIGS. 21 and 22, the hub plate 7 may include the concave portion 71, the convex portion 72, and the hub 73 in the center of the hub plate 7. The hub 73 may correspond to the hub 63 in the blade assembly 6. The hub plate 7 may be integrally injection-molded.

A shape of the convex portion 72 may correspond to the shape of the opening 62 in the blade assembly 6. The fixing portion 61 may be inserted into and welded to the concave portion 71. When the fixing portion 61 is inserted into and welded to the concave portion 71, the convex portion 72 and the fixing portion 61 may form the same plane.

The concave portion 71 may be provided to correspond to the shape of the opening 62 which includes the inclined portion 620. As described above, the inclined portion 620 is formed in the opening 62 of the blade assembly 6 and the concave portion 71 provided in the hub plate 7 is provided to correspond to the shape of the opening 62 which includes the inclined portion 620, thereby more tightly coupling the blade assembly 6 with the hub plate 7.

As described above, the fixing portion 61 is inserted into and welded to the concave portion 71 of the hub plate 7, thereby coupling the blade assembly 6 with the hub plate 7. Also, the convex portion 72 and the fixing portion 61 form the same plane, thereby reducing friction from the air flowing by the hub plate 7 while the centrifugal fan assembly 11 is operating.

As described above, a plurality of blades and a fixing portion provided in a blade assembly are integrally injection-molded, thereby reducing manufacturing costs and times and preventing deterioration of a quality of products. An opening that allows a mold to pass by is formed in the fixing portion, thereby allowing manufacturing the plurality of blades that have a three-dimensional shape using a mold. The fixing portion provided in the blade assembly is inserted into and welded to a concave portion provided in a hub plate, thereby being easily manufactured. Also, the fixing portion and a convex portion of the hub plate form the same plane to not impede an air flow. Accordingly, it is possible to prevent performance of a centrifugal fan assembly from being deteriorated.

It has been described that the fixing portion is provided to have a certain width. However, rear surfaces of the respective blades may function as the fixing portion. That is, the fixing portion and the opening are not additionally provided, and a case where only a hub and a plurality of blades may be integrally injection-molded is possible. For example, the hub plate may include concave portions corresponding to the rear surfaces of the respective blades, and the respective blades may be inserted into and welded to the concave portions provided in the hub plate, thereby manufacturing the centrifugal fan assembly.

The centrifugal fan assembly in accordance with various embodiments of the present disclosure may be applied to devices such as, for example, a refrigerator and air conditioner that need a centrifugal fan assembly.

As is apparent from the above description, a plurality of blades that have a three-dimensional shape are injection-molded at the same time, thereby reducing processes of manufacturing a centrifugal fan assembly. Also, it is possible to reduce noise caused by unbalanced blades.

Although a few embodiments of the present disclosure have been shown and described, it would be appreciated by those skilled in the art that changes may be made in these embodiments without departing from the principles and spirit of the disclosure, the scope of which is defined in the claims and their equivalents.

What is claimed is:

1. A centrifugal fan assembly comprising:

a blade assembly integrally formed, comprising:

a plurality of blades, wherein each blade of the plurality of blades has a twisted shape with a first portion of a hub end of the each blade facing a first adjacent blade, and a second portion of a outer end of the each blade diagonal to the first portion of the hub end facing a second adjacent blade; and a fixing portion integrally connected to the blades; and a hub plate enabled to couple to the fixing portion, wherein the fixing portion comprises at least one opening formed to enable extraction of the blade assembly from a mold during integral injection-molding, and wherein the at least one opening has a shape that is similar to the shape of a hook.

2. The centrifugal fan assembly of claim 1, wherein the fixing portion is connected to the hub end of each of the blades and wherein the hub end of at least one of the blades is adjacent to a portion of the at least one opening formed in the fixing portion.

3. The centrifugal fan assembly of claim 2, wherein the fixing portion has a shape that is similar to the shape of a hook.

4. The centrifugal fan assembly of claim 2, wherein the at least one opening is formed between one of blades and a fixing portion connected to an adjacent blade.

5. The centrifugal fan assembly of claim 1, wherein when viewed from front of the plurality of blades, looking directly onto the outer ends of the blades, the at least one opening is arranged in a part of the fixing portion that overlaps with an area that extends from the outer end along a part of a corresponding one of the plurality of blades.

6. The centrifugal fan assembly of claim 1, wherein the at least one opening is formed around the hub end of the each blade.

7. The centrifugal fan assembly of claim 1, wherein the hub plate comprises a recessed portion enabled to couple to the blade assembly.

8. The centrifugal fan assembly of claim 7, wherein when the fixing portion is located in the recessed portion, a forward surface of the hub plate and a forward surface of the fixing portion form a plane.

9. The centrifugal fan assembly of claim 7, wherein the fixing portion is enabled to be welded to the recessed portion.

10. The centrifugal fan assembly of claim 1, wherein the at least one opening is adjacent to a corresponding one of the plurality of blades.

11. The centrifugal fan assembly of claim 1, wherein the hub plate comprises a first hub.

12. The centrifugal fan assembly of claim 11, wherein the blade assembly comprises a second hub whose shape corresponds to the first hub.

13. The centrifugal fan assembly of claim 11, comprising a shaft mounted on the first hub, wherein the shaft is connected to a fan motor.

14. A centrifugal fan assembly comprising:

a blade assembly comprising a plurality of blades, wherein each of the plurality of blades is integrally formed with a twisted shape; and a hub plate comprising a plurality of recessed portions and a first hub, wherein the blade assembly comprises a fixing portion enabled to couple to the hub plate, wherein an opening is provided on at least one side of each of the plurality of blades to allow the blade assembly to be extracted from a mold when injection-molded, and wherein the opening has a shape that is similar to a shape of a hook.

15. The centrifugal fan assembly of claim 14, wherein the fixing portion is adjacent to one side of the each of the plurality of blades and the opening is formed on another side of corresponding one of the each of the plurality of blades, and the fixing portion has a shape that is similar to the shape of of a hook.

16. The centrifugal fan assembly of claim 14, wherein when viewed from front of the blade assembly, the fixing portion overlaps with a part of the each of the plurality of blades and the opening is larger than an area of another part of the each of the plurality of blades which is not overlapped with the fixing portion.

17. The centrifugal fan assembly of claim 14, wherein when viewed from front the blade assembly, the fixing portion overlaps with a part of the each of the plurality of blades and the opening is a same size as an area of another part of the each of the plurality of blades which is not overlapped with the fixing portion.

18. The centrifugal fan assembly of claim 14, wherein when the blade assembly is coupled to the hub plate, a forward surface of the hub plate and a forward surface of the fixing portion form a plane.

19. The centrifugal fan assembly of claim 14, wherein the fixing portion is enabled to be welded to the recessed portion.

20. The centrifugal fan assembly of claim 14, wherein the fixing portion and the recessed portion have corresponding shapes to fit together.

21. A centrifugal fan assembly comprising:

a blade assembly integrally formed comprising a plurality of blades, wherein each of the plurality of blades has a twisted shape, and a fixing portion connected to the blades and forms one plane; and a hub plate, comprising a hub at a center of the hub plate, enabled to couple to the blade assembly, wherein the blade assembly comprises at least one opening to enable extraction of the blade assembly from a mold during integral injection-molding, wherein the hub plate comprises a recessed portion enabled to couple to the blade assembly, where a forward surface of the fixing portion and a forward surface of the hub plate form a plane, and wherein the at least one opening has a shape that is similar to the shape of a hook.

* * * * *